US007175453B2

(12) United States Patent
Yajima et al.

(10) Patent No.: US 7,175,453 B2
(45) Date of Patent: Feb. 13, 2007

(54) ROTATING CONNECTOR

(75) Inventors: Koichi Yajima, Miyagi-ken (JP); Kazuhiko Ito, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 182 days.

(21) Appl. No.: 11/056,778

(22) Filed: Feb. 11, 2005

(65) Prior Publication Data

US 2005/0180727 A1 Aug. 18, 2005

(30) Foreign Application Priority Data

| | | |
|---|---|---|
| Feb. 12, 2004 | (JP) | 2004-035157 |
| Apr. 15, 2004 | (JP) | 2004-120587 |
| May 10, 2004 | (JP) | 2004-140295 |
| May 10, 2004 | (JP) | 2004-140300 |
| May 10, 2004 | (JP) | 2004-140302 |
| May 10, 2004 | (JP) | 2004-140303 |
| Jun. 18, 2004 | (JP) | 2004-181582 |
| Jun. 25, 2004 | (JP) | 2004-188693 |
| Jun. 25, 2004 | (JP) | 2004-188704 |
| Jun. 30, 2004 | (JP) | 2004-194111 |
| Jul. 8, 2004 | (JP) | 2004-201906 |
| Jul. 22, 2004 | (JP) | 2004-214550 |

(51) Int. Cl.
*H01R 3/00* (2006.01)

(52) U.S. Cl. ..... 439/164; 439/15

(58) Field of Classification Search ..... 439/164, 439/15, 13, 162, 534, 475
See application file for complete search history.

(56) References Cited

U.S. PATENT DOCUMENTS

| | | | | |
|---|---|---|---|---|
| 4,824,396 | A * | 4/1989 | Sasaki et al. | 439/475 |
| 5,735,480 | A * | 4/1998 | Arai et al. | 242/378 |
| 5,813,875 | A * | 9/1998 | Ishikawa et al. | 439/164 |
| 6,012,935 | A * | 1/2000 | Bolen et al. | 439/164 |
| 6,116,930 | A * | 9/2000 | Sakata | 439/164 |
| 6,264,487 | B1 * | 7/2001 | Taniuchi et al. | 439/164 |
| 6,409,527 | B1 | 6/2002 | Adachi et al. | |

FOREIGN PATENT DOCUMENTS

| | | |
|---|---|---|
| DE | 195 34 655 | 3/1997 |
| FR | 2 753 842 | 3/1998 |
| WO | WO 01/08272 | 2/2001 |

* cited by examiner

*Primary Examiner*—Michael C. Zarroli
(74) *Attorney, Agent, or Firm*—Brinks Hofer Gilson & Lione

(57) ABSTRACT

In the rotating connector wherein the rotor having the inner tube is rotatably coupled with the stator having the outer tube, and the flat cable is contained in the annular space defined between the outer tube and the inner tube, the cable winding direction is reversed at the intermediate section, and the intermediate reversing section of the flat cable is passed through the opening of the holder that is rotatably arranged in the annular space. A guiding wall having the outer surface eccentric to the rotating axis of the rotor is provided on the annular flat plate of the holder, and the flat cable is wound on the outer surface of the guiding wall in the wound-back state.

41 Claims, 17 Drawing Sheets

ROTATING CONNECTOR

This application claims the benefit of priority to Japanese Patent Application Nos. 2004-035157 filed on Feb. 12, 2004, 2004-120587 filed on Apr. 15, 2004; 2004-140295 filed on May 10, 2004; 2004-140300 filed on May 10, 2004; 2004-140302 filed on May 10, 2004; 2004-140303 filed on May 10, 2004; 2004-181582 filed on Jun. 18, 2004; 2004-188693 filed on Jun. 25, 2004; 2004-188704 filed on Jun. 25, 2004; 2004-194111 filed on Jun. 30, 2004; 2004-201906 filed on Jul. 8, 2004; and 2004-214550 filed on Jul. 22, 2004, all herein incorporated by reference.

BACKGROUND OF THE INVENTION

1. Field of the Invention

The present invention relates to a rotating connector that is incorporated into vehicular steering equipment to electrically connect the vehicle body with an air bag system etc., and, particularly, a rotating connector in which a flat cable is wound inversely through an inverting section in an annular space defined between a rotor and a stator.

2. Description of the Related Art

A rotating connector contains a pair of rotatably connected housings, one of which is used as a rotor and the other is used as a stator, and in which a flat cable is contained and wound in a space between the rotor and the stator. A rotating connector is used to electrically connect the vehicle body with an air bag system, etc., mounted on a wheel handle that has a number of limited rotations such as vehicular steering equipment. The above-mentioned flat cable is a belt-shaped transmission line carrying a plurality of conductors. Two types of rotating connectors are well known, a swirl-type connector in which a flat cable is wound in a swirl-like shape and a reverse-type connector in which the winding direction of a flat cable is reversed in the intermediate section thereof, and a flat cable can be shortened in the reverse-type connector.

Conventionally, in the reverse-type rotating connector, a flat cable is contained in an annular space defined between the rotor and the stator, the winding direction of which is reversed at the intermediate section thereof, and a holder journaling a plurality of rollers is rotatably arranged in the annular space, and the intermediate reversing section of the flat cable is looped to one of the rollers (for example, see Japanese Unexamined Patent Application Publication No. 2001-126836 (claims 2 to 3, FIG. 4) and U.S. Pat. No. 6,409,527). In the rotating connector of such a configuration, when the rotor is rotated clockwise or counterclockwise, the flat cable is unreeled from the outer tube of the stator and wound on the inner tube of the rotor, or, on the contrary, the flat cable is unreeled from the inner tube and wound back on the outer tube. In this case, the intermediate reversing section of the flat cable rotates in the same direction with the rotor, but by a less rotating angle, which is followed by the holder. And, also the flat cable is unreeled twice as long as the rotating angle from the outer tube or the inner tube. In addition, the winding of the flat cable in the diametric direction is regulated by a plurality of rollers journaled on the holder, thus the flat cable can be unreeled smoothly in the direction of the reversing section.

SUMMARY OF THE INVENTION

In this kind of rotating connector, the cost ratio of the flat cable to the total cost is extremely high, thus the total cost can be decreased as the required length of the flat cable is shortened. However, in the case of the above-mentioned conventional reverse-type rotating connector, the maximum reduction length of the flat cable is as half as that of the swirl-type connector, which is a main reason that impedes a further reduction of the total cost.

The present invention is devised to solve the above-mentioned problem in the related art. An object of the present invention is to provide a rotating connector that can shorten the required length of the flat cable substantially so as to reduce the total cost.

In order to attain the above-mentioned object, in the rotating connector according to a first aspect of the present invention comprising a stator having an outer tube; a rotor having an inner tube that defines an annular space with the above-mentioned outer tube; a flat cable that is contained in the above-mentioned annular space in a state that the winding direction thereof is reversed at the intermediate section, both ends thereof extending outward through the above-mentioned inner tube and the above-mentioned outer tube; and a holder that is rotatably arranged in the above-mentioned annular space and has an opening through which the reversing section of the above-mentioned flat cable is passed, a guide unit surrounding the above-mentioned inner tube with the above-mentioned opening as an anchor is provided on the above-mentioned holder in a fashion that the distance from the rotating axis of the above-mentioned rotor to the outer surface of the above-mentioned guide unit becomes the maximum in the vicinity of the above-mentioned opening.

In the rotating connector of such a configuration, for example, if the rotor is rotated clockwise or counterclockwise when the flat cable is wound on the outer circumferential surface of the inner tube, the flat cable is unreeled from the inner tube to the outer tube, and then if the rotor is further rotated in the same direction, the flat cable that is unreeled to the outer tube is wound back on the outer surface of the guide unit provided on the holder, a wound-back state. On the contrary, if the rotor is rotated in the direction opposite to the above when the flat cable is wound back on the outer surface of the guide portion, the flat cable is unreeled from the outer surface of the guide portion to the outer tube, and then if the rotor is further rotated in the same direction, the flat cable that is unreeled to the outer tube is wounded on the outer circumferential surface of the inner tube, a wound-tight state. In other words, the flat cable is once unreeled to the outer tube in the middle of the transition from the wound-tight state to the wound-back state. However, in the wound-back state, the flat cable is wound on the guide portion of the holder arranged in the annular space, and the total circumferential length of the outer surface of the guide portion is a lot shorter than that of the inner surface of the outer tube, thus the required length of the flat cable can be decreased substantially.

Further, in order to attain the above-mentioned object, in the rotating connector of a second aspect of the present invention comprising a stator having an outer tube; a rotor having an inner tube that defines an annular space with the above-mentioned outer tube; a flat cable that is contained in the above-mentioned annular space in a state that the winding direction thereof is inversed at the intermediate section, both ends thereof extending outward through the above-mentioned inner tube and the above-mentioned outer tube; and a holder that is rotatably arranged in the above-mentioned annular space and has an opening through which the intermediate section of the above-mentioned flat cable is passed, a guiding wall extending to surround the above-mentioned inner tube with the above-mentioned opening as an anchor is provided on the above-mentioned holder in a fashion that the distance from the rotating axis of the above-mentioned rotor to the outer surface of the above-mentioned guiding wall becomes the maximum in the vicinity of the above-mentioned opening.

In the rotating connector of such a configuration, for example, if the rotor is rotated clockwise or counterclockwise when the flat cable is wound on the outer circumferential surface of the inner tube, the flat cable is unreeled from the inner tube to the outer tube, and then if the rotor is further rotated in the same direction, the flat cable that is unreeled to the outer tube is wound back on the outer surface of the guiding wall provided on the holder, the wound-back state. On the contrary, if the rotor is rotated in the direction opposite to the above when the flat cable is wound back on the outer surface of the guiding wall, the flat cable is unreeled from the outer surface of the guiding wall to the outer tube, and then if the rotor is further rotated in the same direction, the flat cable that is unreeled to the outer tube is wounded on the outer circumferential surface of the inner tube, the wound-tight state. In other words, the flat cable is once unreeled to the outer tube in the middle of the transition from the wound-tight state to the wound-back state. However, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially.

In the above-mentioned configuration, it is preferable that the above-mentioned guiding wall has a cylinder-shaped outer surface, and has such a configuration that the flat cable facing the outer tube through the opening is wound on the guiding wall circularly and eccentrically to the rotating axis of the rotor. It is preferable that the above-mentioned guiding wall have a regulating element provided in the vicinity of the opening and an annular element surrounding most of the inner tube, and have such a configuration that the flat cable facing the outer tube through the opening is wound non-circularly on the guiding wall.

Further, in the above-mentioned configuration, it is preferable that a roller is journaled in the vicinity of the opening of the above-mentioned holder, and the flat cable facing the outer tube through the opening is wound on this roller and the above-mentioned guiding wall. In this case, it is preferable that the holder have an annular flat plate having an outer diameter almost the same as the inner diameter of the outer tube, and on this annular flat plate, a roller be journaled and a guiding wall be provided.

Further, in order to attain the above-mentioned object, in the rotating connector of a third aspect of the present invention comprising a stator having an outer tube; a rotor having an inner tube that defines an annular space with the above-mentioned outer tube; a flat cable that is contained in the above-mentioned annular space in a state that the winding direction thereof is reversed at the intermediate section, both ends thereof extending outward through the above-mentioned inner tube and the above-mentioned outer tube; and a holder that is rotatably arranged in the above-mentioned annular space and has an opening through which the reversing section of the above-mentioned flat cable is passed, a guiding wall extending to surround the above-mentioned inner tube with the above-mentioned opening as an anchor is provided on the above-mentioned holder in a fashion that the distance from the rotating axis of the above-mentioned rotor to the outer surface of the above-mentioned guiding wall becomes the maximum in the vicinity of the above-mentioned opening, and the outer surface of the guiding wall is shaped unevenly to reduce the contact area with the above-mentioned flat cable.

In the rotating connector of such a configuration, the flat cable is once unreeled in the middle of the transition from the wound-tight state to the wound-back state, however, in the wound-back state, the flat cable is wound on the outer surface of the guiding wall of the holder arranged in the annular space, and the total circumferential length of the outer surface of the guiding wall is a lot shorter than that of the inner surface of the outer tube, thus the required length of the flat cable can be decreased substantially. In addition, the outer surface of the guiding wall of the holder is shaped unevenly to reduce the contact area with the flat cable, therefore, in the winding operation, the flat cable does not adhere to the outer surface of the guiding wall and is unreeled smoothly, thus the rotor or the holder can rotate smoothly.

In the above-mentioned configuration, the shape of the uneven outer surface is not limited thereto. For example, the uneven outer surface of the guiding wall can be formed by sprinkling a number of hemispheric concavities on the face or by making the guiding wall in a wave-like shape. However, it is preferable that convexities and concavities be formed alternately along the circumferential direction on the outer surface of the guiding wall. In addition, the guiding wall of the holder extends to surround the inner tube with, as an anchor, the opening through which the intermediate inverting section of the flat cable is passed, however, it is preferable that the guiding wall have an outer surface eccentric to the inner surface extending in a concentric circle shape to the inner tube, and the concave cavities be formed between the inner surface and the outer surface of the guiding wall, which can reduce the weight and cost of the holder. In addition, it is preferable that the holder have an annular flat plate having an outer diameter almost the same as the inner diameter of the outer tube, and the guiding wall be provided on the annular flat plate, because the holder can be rotated smoothly in the annular space.

Further, in order to attain the above-mentioned object, in the rotating connector of a fourth aspect of the present invention comprising a stator having an outer tube; a rotor having an inner tube that defines an annular space with the above-mentioned outer tube; a flat cable that is contained in the above-mentioned annular space in a state that the winding direction thereof is reversed at the intermediate section, both ends thereof extending outward through the above-mentioned inner tube and the above-mentioned outer tube; and a holder that is rotatably arranged in the above-mentioned annular space and has an opening through which the reversing section of the above-mentioned flat cable is passed, a guiding wall having an outer surface eccentric to the inner surface extending in a concentric circle shape to the above-mentioned inner tube is provided on the above-mentioned holder, and the opening through which the inverting section of the above-mentioned flat cable is passed is provided in the location where the diameter of the guiding wall becomes the maximum, and also a concave wall and a convexity-shaped wall facing to each other with the above-mentioned opening between them are shaped as one body in the above-mentioned guiding wall.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, the movement of the flat cable in the diametric direction is regulated by the inner surface of the guiding wall even when a plurality of rollers are in used, the configuration of the holder can be simplified.

Further, in order to attain the above-mentioned object, in the rotating connector of a fifth aspect of the present invention comprising a stator having an outer tube, a rotor having an inner tube that defines an annular space with the above-mentioned outer tube; a flat cable that is contained in the above-mentioned annular space in a state that the winding direction thereof is inversed at the intermediate section, both ends thereof extending outward through the above-mentioned inner tube and the above-mentioned outer tube, and a holder that is rotatably arranged in the above-mentioned annular space and has an opening through which the inverting section of the above-mentioned flat cable is passed, an inner wall extending in a circumferential direction to surround most of the above-mentioned inner tube, and a coupling wall portion extending outward along the above-mentioned opening from the inner wall portion, and an outer wall portion extending to the above-mentioned inner wall from the outer end of the coupling wall are provided on the above-mentioned holder, thus the above-mentioned flat cable is slid from the above-mentioned inner tube and through the above-mentioned opening and, is wound non-circularly on the above-mentioned inner wall portion and the above-mentioned outer wall portion.

In the rotating connector of such a configuration, for example, if the rotor is rotated clockwise or counterclockwise when the flat cable is wound on the outer circumferential surface of the inner tube, the flat cable is unreeled from the inner tube to the outer tube, and then if the rotor is further rotated in the same direction, the flat cable that is unreeled to the outer tube is wound back on the outer surface of the guiding wall provided on the holder, the wound-back state. On the contrary, if the rotor is rotated in the direction opposite to the above when the flat cable is wound back on the outer surface of the guiding wall, the flat cable is unreeled from the outer surface of the guiding wall to the outer tube, and then if the rotor is further rotated in the same direction, the flat cable that is unreeled to the outer tube is wounded on the outer circumferential surface of the inner tube, the wound-tight state. In other words, the flat cable is once unreeled to the outer tube in the middle of the transition from the wound-tight state to the wound-back state. However, in the wound-back state, the flat cable is wound on the guiding wall of the holder arranged in the annular space, and the total circumferential length of the outer surface of the guiding wall is a lot shorter than of the inner surface of the outer tube, thus the required length of the flat cable can be decreased substantially. In addition, the inner wall portion, the coupling wall portion and the outer wall portion are provided on the holder to guide the flat cable, thus the weight and cost of the holder can be decreased, and the rotor can rotate smoothly.

In the above-mentioned configuration, it is preferable that the holder have an annular flat plate having an outer diameter almost the same as the inner diameter of the outer tube, and the inner wall portion, the coupling wall portion and the outer wall portion be provided on this annular flat plate, because the holder can rotate smoothly in the annular space.

Further, in the above-mentioned configuration, it is preferable that a roller be rotatably journaled on the holder and face the coupling wall portion with the opening between them, because the intermediate reversing section of the flat cable can be passed smoothly through the opening. In this case, it is preferable that an opposing wall facing the coupling wall with the opening between them and the roller be provided on the holder, and the inner end of the opposing wall be coupled with the inner wall portion, and also another outer wall extending to the inner wall be provided at the outer end of the opposing wall, because the flat cable can be wound non-circularly on the inner wall portion and a pair of the outer wall portions.

Further, in order to attain the above-mentioned object, in the rotating connector of a sixth aspect of the present invention comprising a stator having an outer tube, a rotor having an inner tube that defines an annular space with the above-mentioned outer tube, a flat cable that is contained in the above-mentioned annular space in a state that the winding direction thereof is reversed at the intermediate section, both ends thereof extending outward through the above-mentioned inner tube and the above-mentioned outer tube, and a holder that is rotatably arranged in the above-mentioned annular space and has an opening through which the reversing section of the above-mentioned flat cable is passed, an annular flat plate having a center hole through which the above-mentioned inner tube is inserted is provided on the holder, a plurality of columns are provided on the annular flat plate to surround the above-mentioned center hole, and these columns are dispersed in the non-circular area in which the distance from the rotating axis of the above-mentioned rotor becomes the maximum in the vicinity of the above-mentioned opening, and the above-mentioned flat cable is slid from the above-mentioned inner tube and through the above-mentioned opening, and is wound non-circularly on the above-mentioned columns located along the outer edge of the above-mentioned non-circular area.

In the rotating connector of such a configuration, for example, if the rotor is rotated clockwise or counterclockwise when the flat cable is wound on the outer circumferential surface of the inner tube, the flat cable is unreeled from the inner tube to the outer tube, and then if the rotor is further rotated in the same direction, the flat cable that is unreeled to the outer tube is wound back non-circularly on the plurality of columns provided on the holder, the wound-back state. On the contrary, if the rotor is rotated in the direction opposite to the above when the flat cable is wound back on the inner wall and the outer wall of the holder, the flat cable is unreeled from the columns of the holder to the outer tube, and then if the rotor is further rotated in the same direction, the flat cable that is unreeled to the outer tube is wounded on the outer circumferential surface of the inner tube, the wound-tight state. In other words, the flat cable is once unreeled to the outer tube in the middle of the transition from the wound-tight state to the wound-back state. However, in the wound-back state, the flat cable is wound non-circularly on each column of the holder arranged in the annular space, and the total length along the non-circular winding path is a lot shorter than the circumferential length of the inner surface of the outer tube, thus the required length of the flat cable can be decreased substantially. In addition, a plurality of columns are provided in the non-circular area on the holder to guide the flat cable, thus the weight and the cost of the holder can be decreased, and the rotor can be rotated smoothly.

In the above-mentioned configuration, all the columns are not required to have the same shape. Particularly, it is preferable that the columns coupled along the outer edge of the non-circular area from the opening be wedge-shaped, and the others are cylinder-shaped, because the bucking transformation of the intermediate inverting section of the flat cable can be prevented when the intermediate inverting section of the flat cable passes through the opening, and the flat cable can be wound tight or back smoothly when the rotor rotates.

Further, in the above-mentioned configuration, it is preferable that a part or all of the columns have rollers rotatably journaled thereon, because the flat cable can be wound tight or back smoothly when the rotor rotates.

Further, in order to attain the above-mentioned object, in the rotating connector of a seventh aspect of the present invention comprising a stator having an outer tube, a rotor having an inner tube that defines an annular space with the above-mentioned outer tube, a flat cable that is contained in the above-mentioned annular space in a state that the winding direction thereof is reversed at the intermediate section, both ends thereof extending outward through the above-mentioned inner tube and the above-mentioned outer tube and a synthetic resin holder rotatably arranged in the above-mentioned annular space, a plurality of hollow tube-shaped walls are sprinkled on the above-mentioned holder in the circumferential direction to surround the above-mentioned inner tube, and an imaginary inner circumferential surface joining the inner sides of these hollow tube-shaped walls is set almost concentric to the above-mentioned inner tube, and an imaginary outer circumferential surface joining the outer sides of the above-mentioned hollow tube-shaped walls is made eccentric to the center of the above-mentioned inner tube, and the opening through which the reversing section of the above-mentioned flat cable is passed is provided in the location where the diameter of the imaginary outer circumferential surface becomes the maximum.

In the rotating connector of such a configuration, for example, if the rotor is rotated clockwise or counterclockwise when the flat cable is wound on the outer circumferential surface of the inner tube, the flat cable is unreeled from the inner tube to the outer tube, and then if the rotor is further rotated in the same direction, the flat cable that is unreeled to the outer tube is wound back on the outer surface of the hollow tube-shaped walls provided on the holder, the wound-back state. On the contrary, if the rotor is rotated in the direction opposite to the above when the flat cable is wound back on the outer surface of the hollow tube-shaped walls, the flat cable is unreeled from the outer surface of the hollow tube-shaped walls to the outer tube, and then if the rotor is further rotated in the same direction, the flat cable that is unreeled to the outer tube is wounded on the outer circumferential surface of the inner tube, the wound-tight state. In other words, the flat cable is once unreeled to the outer tube in the middle of the transition from the wound-tight state to the wound-back state. However, in the wound-back state, the flat cable is wound on each hollow tube-shaped wall of the holder arranged in the annular space, and the total circumferential length of the imaginary outer circumferential surface joining the outer side of the hollow tube-shape wall is a lot shorter than that of the inner surface of the outer tube, thus the required length of the flat cable can be decreased substantially. In addition, each hollow tube-shaped wall guiding the flat cable is shaped like a hollow tube-shaped element that contains no synthetic resin in it, thus the weight and cost of the holder can be reduced, and the rotor can rotate smoothly.

In the above-mentioned configuration, it is preferable that the holder have an annular flat plate with an outer diameter almost the same as the inner diameter of the outer tube, and each hollow tube-shaped wall is provided on this annular flat plate, because the holder can rotate smoothly in the annular space.

Further, in the above-mentioned configuration, it is preferable that complementary walls be provided between the hollow tube-shaped walls on the holder and be arranged along the imaginary inner circumferential surface joining the inner sides of the hollow tube-shaped walls, because the complimentary walls prevent the flat cable from evaginating outwards through the space between the hollow tube-shaped walls, and the flat cable can be wound tight or back smoothly.

Further, in order to attain the above-mentioned object, in the rotating connector of an eighth aspect of the present invention comprising a stator having an outer tube, a rotor having an inner tube that defines an annular space with the above-mentioned outer tube, a flat cable that is contained in the above-mentioned annular space in a state that the winding direction thereof is reversed at the intermediate section, both ends thereof extending outward through the above-mentioned inner tube and the above-mentioned outer tube, and a synthetic resin holder that is rotatably arranged in the above-mentioned annular space and has an opening through which the inverting section of the above-mentioned flat cable is passed, an annular flat plate having an outer diameter almost the same as the inner diameter of the above-mentioned outer tube on the above-mentioned holder, and a guiding wall having an outer surface eccentric to the inner surface extending in a concentric circle shape to the above-mentioned inner tube on this annular flat plate, and also an opening through which the intermediate inverting section of the flat cable is passed is provided in the location where the diameter of the guiding wall becomes the maximum, and the synthetic resin-removed part is formed in at least one of the above-mentioned annular flat plate and the above-mentioned guiding wall.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, the synthetic resin-removed part is formed in at least one of the annular flat plate and the guiding wall of the holder, thus the weight and cost of the holder can be reduced, and the rotor can rotate smoothly.

In the above-mentioned configuration, the above-mentioned synthetic resin-removed part can be formed by forming a concave cavity between the inner surface and the outer surface of the guiding wall, or by forming a plurality of holes penetrating the inner surface and the outer surface of the guiding wall, or by forming a plurality of holes penetrating the annular flat plate. In this case, only a single type of the above-mentioned synthetic resin-removed part may be formed, however, it is preferable that a plurality types of synthetic resin-removed part be formed on the holder, for example, a plurality of the holes are formed on the annular flat plate, and, at the same time, concave cavities are formed between the inner surface and the outer surface of the guiding wall, which can reduce the weight and cost of the holder more effectively.

Further, in order to attain the above-mentioned object, in the rotating connector of a ninth aspect of the present invention comprising a stator having a lower plate and an outer tube, a rotor having an upper plate and an inner tube, and rotatably coupled to the above-mentioned stator, a flat cable that is contained in the above-mentioned annular space in a state that the winding direction thereof is reversed at the intermediate section, both ends thereof extending outward through the above-mentioned inner tube and the above-mentioned outer tube; and a synthetic resin holder rotatably arranged in the above-mentioned annular space, an annular flat plate having an outer diameter almost the same as the inner diameter of the above-mentioned outer tube and facing the above-mentioned lower plate is provided on the above-mentioned holder, and a guiding wall having an outer surface eccentric to the inner surface extending in a concentric circle shape to the above-mentioned inner tube on this annular flat plate, and also an opening through which the intermediate inverting section of the flat cable is passed is provided in the location where the diameter of the guiding wall becomes the maximum, and first resilient urging elements urging the above-mentioned lower plate and the above-mentioned annular flat plate in the direction that they separate from each other.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, the urging elements resiliently urging the guiding wall of the holder to the upper plate of the rotor are provided on at least one of the lower plate of the stator and the guiding wall of the holder, thus the holder is restrained from moving up and down in the annular space even when the vibration in the rotating axis direction of the rotor is applied from the external, thus the noise due to the collision of the holder with the upper plate or the lower plate can be reduced.

In the above-mentioned configuration, it is preferable that the above-mentioned first resilient urging elements consist of resilient tongues formed as one body in a cantilevered crossbeam shape on the annular flat plate of the holder, and the free ends of the resilient tongues be in contact with the lower plate of the stator resiliently, because a simple structured resilient urging element can be attained. In this case, it is preferable that at least more than three resilient tongues be formed along the circumferential direction of the annular flat plate, because the lower plate can support the holder stably. In addition, it is preferable that a curved surface be formed at the free end of each resilient tongues, because the holder can rotate smoothly on the lower plate.

Further, in order to attain the above-mentioned object, in the rotating connector of a tenth aspect of the present invention comprising a stator having a lower plate and an outer tube, a rotor having an upper plate and an inner tube, and rotatably coupled to the above-mentioned stator, a flat cable that is contained in the above-mentioned annular space in a state that the winding direction thereof is reversed at the intermediate section, both ends thereof extending outward through the above-mentioned inner tube and the above-mentioned outer tube, and a holder having an annular flat plate facing the above-mentioned lower plate and a guiding wall that is rotatably provided in the above-mentioned annular space, the intermediate inverting section of the flat cable is arranged in the opening provided in the above-mentioned guiding wall, and the inner surface of the above-mentioned guiding wall is formed in a concentric circle shape to the circular penetrating hole drilled in the center of the above-mentioned annular flat plate, and the distance from the rotating axis of the above-mentioned rotor to the outer surface of the above-mentioned guiding wall becomes the maximum in the vicinity of the above-mentioned opening, and a small-diameter part coupled to the above-mentioned rotor through the above-mentioned inner tube and a stepped-part is formed, and second resilient urging elements pushing and contacting the circumferential edge of the above-mentioned penetrating hole into the above-mentioned small-diameter part of the above-mentioned stepped part.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, the small-diameter part coupled to the rotor through the inner tube and the stepped-part is formed, and the penetrating hole drilled in the center of the annular flat plate of the holder is put into the small-diameter part, and the circumferential edge of this penetrating hole is pushed and contacted to the stepped-part by the second resilient urging element, thus the holder is restrained from moving up and down in the annular space even when the vibration in the rotating axis direction of the rotor is applied from the external, and the noise due to the collision of the holder with the upper plate or the lower plate can be decreased.

In the above-mentioned configuration, it is preferable that the above-mentioned annular flat plate have an outer diameter almost the same as the inner diameter of the outer tube, and the second resilient urging elements be a plurality of resilient tongues formed as one body in a cantilevered crossbeam shape on the annular flat plate, because a simple-structured resilient urging element can be attained. In this case, it is preferable that a curved face be formed at the free end of each resilient tongue, and this curved face be resiliently pushed and contacted to the lower plate of the stator, because the holder can rotate smoothly on the lower plate. In addition, it is preferable that at least more than three resilient tongues are formed along the circumferential direction at regular intervals on the annular flat plate, because the lower plate can support the holder stably.

Further, in order to attain the above-mentioned object, in the rotating connector of an eleventh aspect of the present invention comprising a stator having a lower plate and an outer tube, a rotor having an upper plate and an inner tube and rotatably coupled to the above-mentioned stator, a flat cable that is contained in the above-mentioned annular space in a state that the winding direction thereof is reversed at the intermediate section, both ends thereof extending outward through the above-mentioned inner tube and the above-mentioned outer tube, and a holder that is rotatably arranged in the above-mentioned annular space, an annular flat plate facing the above-mentioned lower plate is provided on the above-mentioned holder, and a guiding wall having an outer surface eccentric to the inner surface extending in a concentric circle shape to the above-mentioned inner tube is provided on the annular flat plate, and an opening through which the intermediate reversing section of the flat cable is passed is provided in the location where the diameter of the guiding wall becomes the maximum, and lubricative sheet is adhered on the upper face of the above-mentioned lower plate.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, the lubricative sheet is adhered on the upper face of the lower plate that forms the lower opening end of the annular space, thus the annular flat plate of the holder slides on the lubricative sheet and rotates in the annular space, and, finally, the sliding noise from the contact area between the holder and the lower plate can be decreased.

In the above-mentioned configuration, the lower face of the annular flat plate of the holder slides on the lubricative sheets. However, it is preferable that curved protrusions be formed on the lower face of the annular flat plate, because only these protrusions slide on the lubricative sheets, thus the sliding friction can be decreased and, finally, the holder can rotate smoothly.

Further, in the above-mentioned configuration, if lubricative sheet is adhered on the lower face of the upper plate forming the upper opening end of the annular space, the flat cable slides with itself in contact with these lubricative sheet and transposes in the wound-tight or back operation, thus the sliding noise from the contact between the flat cable and the upper plate as well as that between the above-mentioned holder and the lower plate can be decreased, and, finally, the noise can be decreased more effectively.

Further, in order to attain the above-mentioned object, in the rotating connector of a twelfth aspect of the present invention comprising a stator having an outer tube, a rotor having an inner tube that is rotatably coupled to this stator and defines an annular space with the above-mentioned outer tube, a flat cable that is contained in the above-mentioned annular space in a state that the winding direction thereof is reversed at the intermediate section, both ends thereof extending outward through the above-mentioned inner tube and the above-mentioned outer tube, and a holder that is rotatably arranged in the above-mentioned annular space, an annular flat plate facing the above-mentioned lower plate is provided on the above-mentioned holder, and a guiding wall having an outer diameter eccentric to the inner diameter extending in a concentric circle shape to the above-mentioned inner tube is provided on this annular flat plate, and an opening through which the intermediate inverting section of the flat cable is passed is provided in the location where the diameter of the guiding wall becomes the maximum, and also an resilient restraining piece extending to the inside of the above-mentioned annular space is provided in the above-mentioned outer tube.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guiding wall is a lot shorter than that of the inner surface of the outer tube, thus the required length of the flat cable can be decreased substantially. In addition, an resilient restraining piece extending to the inside of the annular space is provided in the outer tube, and the resilient restraining piece urges the flat cable to the outer surface of the guiding wall, thus the vibration of the flat cable in the diametric direction is restrained even when the vibration in a diametric direction of the annular space is applied externally, and the noise occurrence can be decreased.

In the above-mentioned configuration, the number of the resilient restraining piece is not limited, however, it is preferable that a plurality of resilient restraining pieces be provided along the circumferential direction of the outer tube at regular intervals, because the flat cable can be elastically urged in a balanced manner to the center of the annular space.

Further, in the above-mentioned configuration, it is preferable that the resilient restraining pieces be formed in a bow shape, and one end of the resilient restraining piece be supported in a cantilevered crossbeam shape by the outer tube, because the resilient restraining piece can be provided easily on the outer tube.

Further, in order to attain the above-mentioned object, in the rotating connector of a thirteenth aspect of the present invention comprising a stator having a lower plate and an outer tube, a rotor having an upper plate and an inner tube, and rotatably coupled to the above-mentioned stator, a flat cable that is contained in the above-mentioned annular space in a state that the winding direction thereof is reversed at the intermediate section, both ends thereof extending outward through the above-mentioned inner tube and the above-mentioned outer tube, and a guide portion that is rotatably arranged in the above-mentioned annular space, the above-mentioned guide portion is a C-shaped element having an outer surface eccentric to the surface wall extending in a concentric circle shape to the above-mentioned inner tube, and an opening through which the intermediate inverting section of the flat cable is passed is provided in the location where the diameter of the guide portion becomes the maximum, and the protrusions protruded from the lower end of the above-mentioned inner surface of the guide portion are slidably engaged with an annular guiding grooved formed on the above-mentioned lower plate.

In the rotating connector of such a configuration, the flat cable is once unreeled to the outer tube in the middle of the transition from the wound-tight state to the wound-back state, however, in the wound-back state, the flat cable is wound on the guiding wall of the holder arranged in the annular space, and the total circumferential length of the outer surface of the guide portion is a lot shorter than that of the inner surface of the outer tube, thus the required length of the flat cable can be decreased substantially. In addition, the guide portion is a C-shaped element whose outer wall is eccentric to the cylinder-shaped inner surface, and the protrusions protruded from the lower end of the inner surface of the guide portion are slidably engaged with the annular guide grooves formed on the lower plate of the stator, thus the weight of the guide portion can be reduced, and the guide portion can rotate smoothly.

In the above-mentioned configuration, the above-mentioned protrusions may be formed consecutively along the whole inner surface of the guide portion, or a plurality of protrusions may be sprinkled intermittently along the inner surface of the guide portion.

Further, in the above-mentioned configuration, it is preferable that concave cavities be formed between the inner surface and the outer surface of the above-mentioned guide portion, because the weight of the guide portion can be further decreased.

Further, in the above-mentioned configuration, it is preferable that a third resilient urging element urging both of the above-mentioned guide portion and the upper plate of the rotor in the direction that they separate from each other be provided on at least one of the upper end of the above-mentioned guide portion and the upper plate of the rotor, because the guide portion is restrained from moving up and down in the annular space by the third resilient urging element even when the vibration in the rotating axis direction of the rotor is applied externally, and thus the noise due to the collision of the guide portion with the upper plate can be decreased. In this case, it is preferable that the third resilient urging element consist of a plurality of elastic tiny pieces formed as one body at the upper end of the inner surface of the guide portion, because if the free ends of these resilient tongues pieces are in contact with the lower face of the upper plate elastically, the simple-structured third resilient urging element can be attained.

DESCRIPTION OF THE PREFERRED EMBODIMENT

Figure 1:
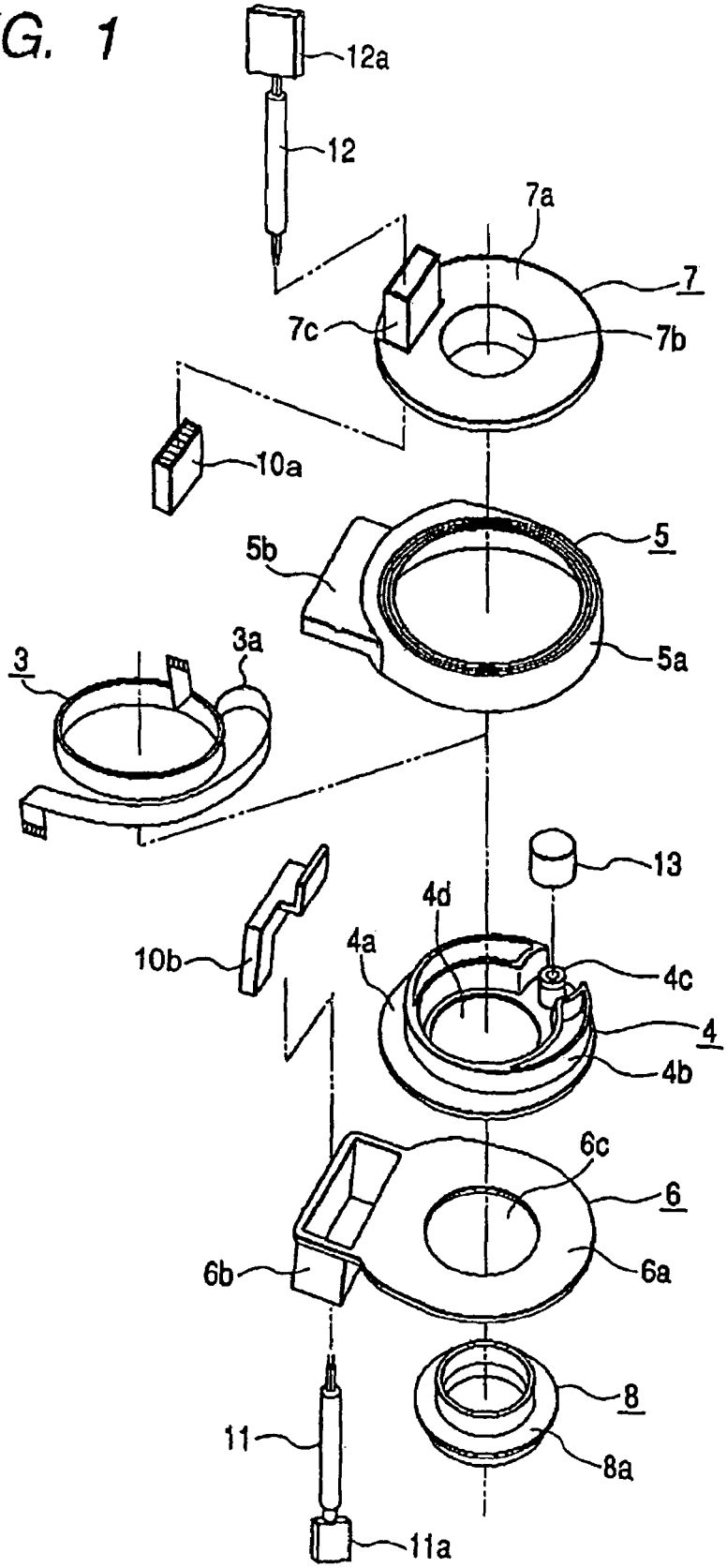
FIG. 1 is a exploded perspective view of the rotating connector relating to the first embodiment of the present invention.

A first embodiment according to the first and the second aspects of the present invention will be described with reference to the accompanying drawings. FIG. 1 is a exploded view illustrating the rotating connector of the first embodiment of the present invention, and FIG. 2 is a cross sectional view illustrating the rotating connector, and FIG. 3 is a perspective view illustrating the holder included in the rotating connector, and FIG. 4 is an explanatory view illustrating the operation of the rotating connector.

Figure 2:
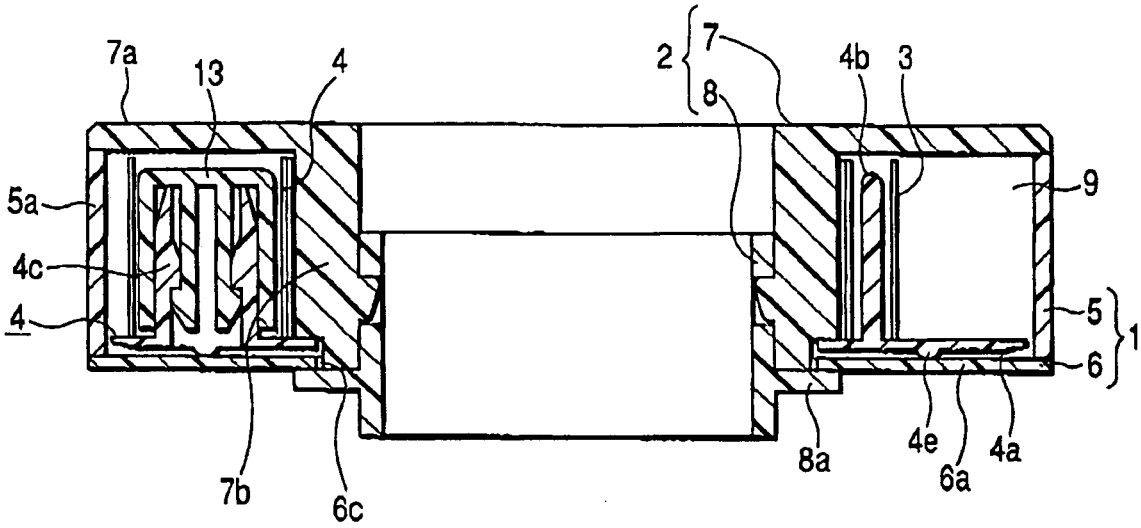
FIG. 2 is a cross sectional view of the rotating connector.
Figure 3:
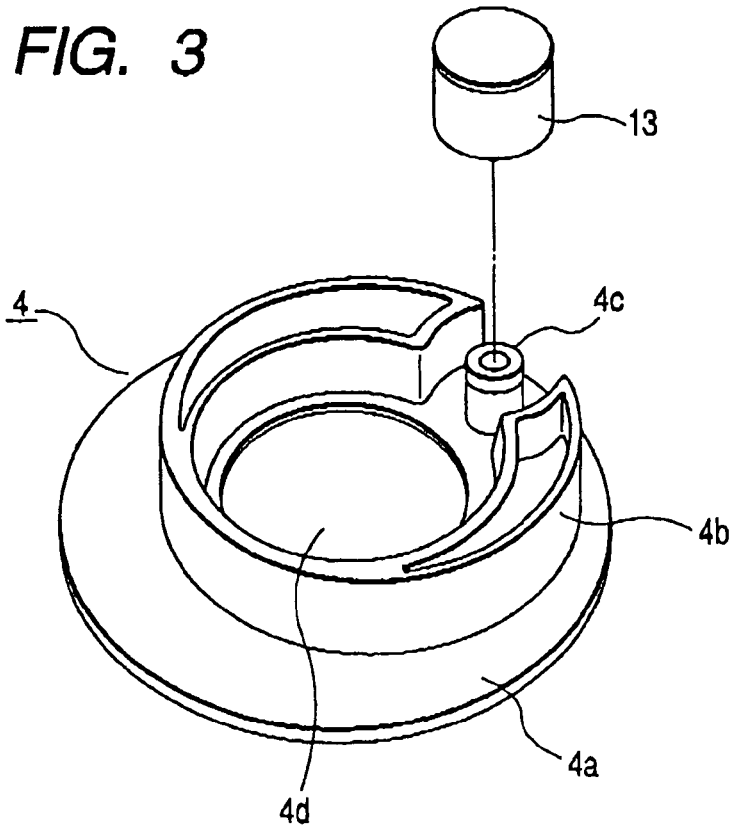
FIG. 3 is a perspective view of the holder included in the rotating connector.

As shown in FIGS. 1 to 3, the rotating connector relating to the present invention comprises a stator 1; a rotor 2 rotatably coupled to the stator 1; a flat cable 3 electrically connecting the stator 1 and the rotor 2; and a holder 4 rotatably arranged between the stator 1 and the rotor 2.

The stator 1 is a fid fixed to a steering column, and composed of a resin case 5 and a cover 6 that are made of synthetic resin. The case 5 comprises an outer tube 5*a* and lid element 5*b* protruding outward from the outer surface of the outer tube 5*a*, and the cover 6 comprises a lower plate 6*a* and a lower containing element 6*b* protruding from the outer edge of the lower plate 6*a*. A center hole 6*c* is formed at the center of the lower plate 6*a*, and the lower end of the case 5 and the outer edge of the cover 6 are snap-coupled to be a unit, and then the lower opening of the outer tube 5*a* is closed by the lower plate 6*a*, and the upper opening of the lower containing element 6*b* is closed by the lid element 5*b*.

The rotor 2 is a movable element coupled to a handle, and composed of an upper rotor 7 and a lower rotor 8 that are made of synthetic resin. The upper rotor 7 comprises an annular upper plate 7*a* and an inner tube 7*b* extending downward from the center of the upper plate 7*a*, and an upper containing element 7*c* is provided on the upper plate 7*a*. The inner tube 7*b* has an inner diameter that is large enough to be put into a steering shaft, and the lower rotor 8 is incorporated to the inner surface of this inner tube 7*b*. The lower rotor 8 is a cylinder-shaped element having a guard member 8*a*, and the lower rotor 8 is inserted from the center hole 6*c* of the cover 6 and snap-coupled to the inner tube 7*b*, then the rotor 2 is rotatably coupled to the stator 1. And in such a state, the outer tube 5*a* and the lower plate 6*a* of the stator 1; and the upper plate 7*a* and the inner tube 7*b* of the rotor 2 define a ring-shaped annular space 9 in plan view.

The flat cable 3 is a belt-shaped transmission line containing a plurality of parallel conductors laminated by a pair of insulation films, and the flat cable 3 is contained in the annular space 9 with itself reversed through a U-shaped reversing section 3*a*. Both ends of the flat cable 3 are connected with lead blocks 10*a*, 10*b*. One of the lead blocks is fixed in the lower containing element 6*b* of the cover 6, and this lead block 10*b* is connected with a lead wire 11 having an external connector 11*a* at its front end. In addition, the other lead block 10*a* is fixed in the upper containing element 7*c* of the upper rotor 7, and connected with a lead wire 12 having an external connector 12*a* at its front end.

The holder 4 comprises an annular flat plate 4*a* loaded on the lower plate 6*a* of the cover 6; a guiding wall 4*b* as a guide portion provided on this annular flat plate 4*a*; and a supporting axis 4*c*, and these are shaped as one body with synthetic resin. The annular flat plate 4*a* has an outer diameter almost the same as the inner diameter of the outer tube 5*a*, and has a guide hole 4*d* formed in its center. The guide hole 4*d* is put into the lower outer circumferential surface of the inner tube 7*b*, and the holder 4 can slide on the inner tube 7*b* and rotate in the annular space 9. In addition, on the lower face of the annular flat plate 4*a* are formed protrusions 4*e* to reduce the sliding friction with the lower plate 6*a*. The guiding wall 4*b* is shaped on the annular flat plate 4*a* in such a fashion that the guiding wall surrounds almost all the guide hole 4*d*, and the inner surface of the guiding wall is almost concentric to the guide hole 4*d*, but the outer circumferential surface is substantially eccentric to the guide hold 4*d*. A part of the guiding wall 4*b* is notched on the annular flat plate 4*a*, and a cylinder-shaped supporting axis 4*c* is provided in the notched portion. By this supporting axis 4*c* is rotatably supported a roller 13, and the above-mentioned inverting section 3*a* of the flat cable 3 is located in the opening 14 formed between the roller 13 and the side face of the guiding wall 4*b* facing the roller 13 (see FIG. 4). Therefore the distance from the rotating axis of the rotor 2 to the outer wall as an outer portion of the guiding wall 4*b* becomes the maximum in opposing portions with an opening 14 inserted therebetween, and the minimum in the location that is opposite to the roller 13.

Next, the operation of the rotating connector of such a configuration will be described with reference to FIG. 4. In addition, in FIG. 4, the stator 1 and the rotor 2 including the outer tube 5*a* and the inner tube 7*b* are omitted.

Figure 4A:
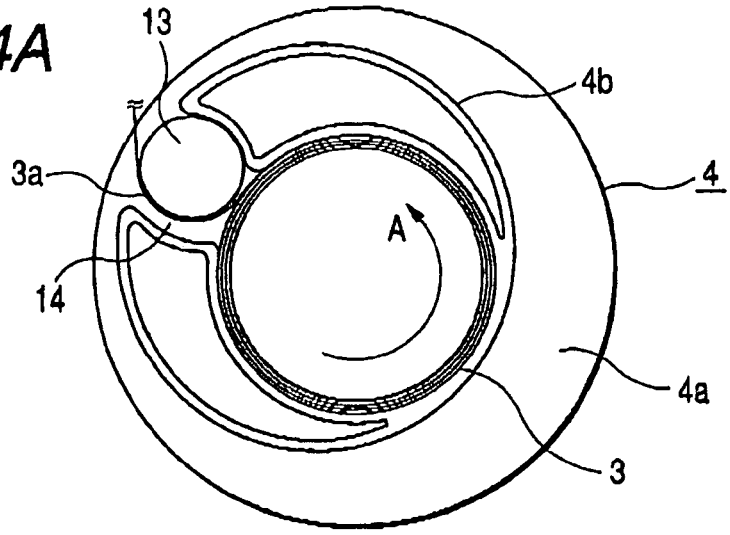
FIG. 4 is an explanatory view illustrating the operation of the rotating connector.
Figure 4B:
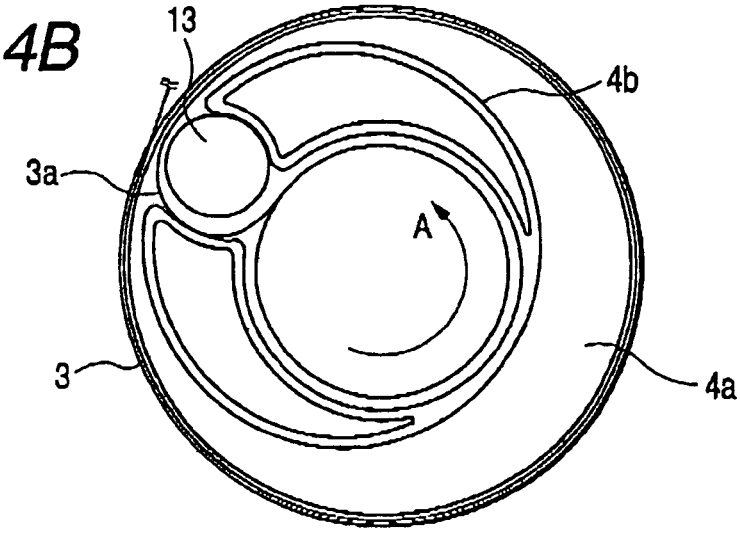
Figure 4C:
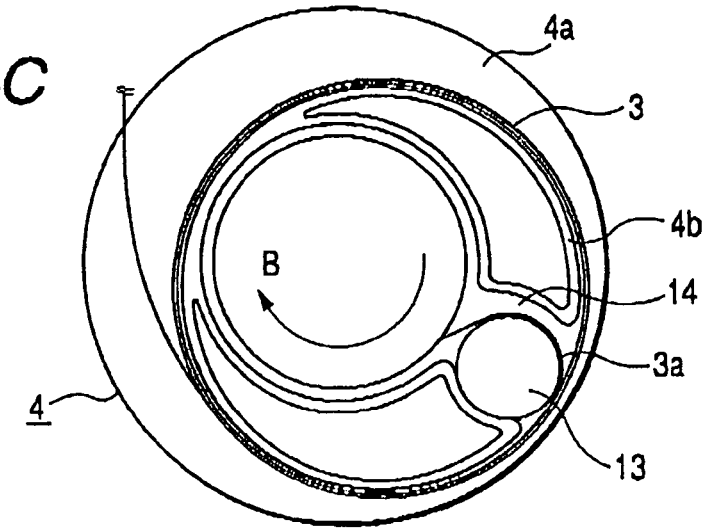

FIG. 4A illustrates the wound-tight state in which most part of the flat cable 3 is wound on the outer wall of the inner tube 7*b*. If the rotor 2 is rotated counterclockwise (the direction of arrow A) in this state, the reversing section 3*a* of the flat cable 3 moves counterclockwise by rotating angle smaller than that of the rotor 2, and the roller 13 and the holder 4 follow the reversing section 3*a* to move counterclockwise, and, as shown in FIG. 4B, the flat cable 3 is unreeled twice as much as the rotating angle from the inner tube 7*b* to the inner circumferential surface of the outer tube 5*a*. If the rotor 2 is further rotated counterclockwise, as shown in FIG. 4C, the flat cable 3 unreeled to the outer tube 5*a* is wound on the outer surface of the guiding wall 4*b* of the holder 4, and, finally, most part of the flat cable is wound on the outer surface of the guiding wall 4*b* to be in the wound-back state. On the contrary, if the rotor is rotated clockwise (the direction of arrow B) in the wound-back state shown in FIG. 40, the flat cable 3 is unreeled to the inner circumferential surface of the outer tube 5*a* from the guiding wall 4*b*, and, if the rotor 2 is further rotated clockwise, as shown in FIG. 4A, most of the flat cable 3 is wound on the outer circumferential surface of the inner tube 7*b*, the wound-tight state.

As above, in the rotating connector relating to the present embodiment, in the middle of the transition between the wound-tight state shown in FIG. 4A or the wound-back state shown in FIG. 4C, the flat cable 3 is once unreeled to the outer tube 5*a* located in the outside of the holder 4, but it is wound on the guiding wall 4*b* of the holder 4 arranged in the annular space in the wound-back state, and the circumference of the outer surface of the guiding wall 4*b* is much smaller than that of the inner wall of the outer tube 5*a*, thus the length of the required flat cable 3 can be decreased substantially.

Figure 5A:
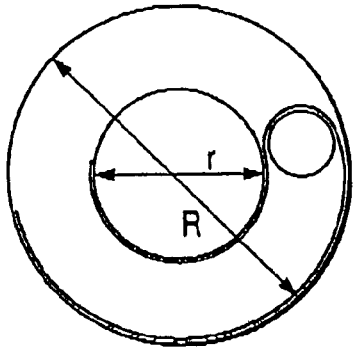
FIG. 5 is an explanatory view illustrating the comparison of the shortening effect in the flat cable length.
Figure 5B:
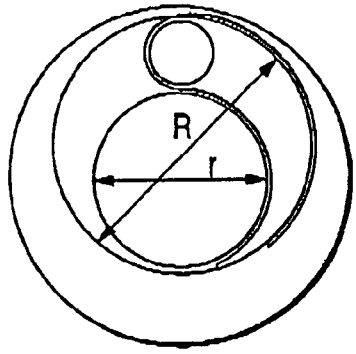

Such a decrease in the length of the flat cable 3 will be described with reference to FIG. 5. FIG. 5A illustrates a conventional rotating connector in which the flat cable is wound on the outer tube in the wound-back state, and FIG. 5B illustrates the rotating connector relating to the present embodiment in which the flat cable is wound on the guiding wall of the holder in the wound-back state. In both rotating connectors, if the inner diameter of the flat cable route (the diameter of the wound-tight state) is r, the outer diameter of the flat cable route (the diameter of the wound-back state) is R, and the rotation number of the rotor is N, the length L of the required flat cable 3 satisfies the following equation (1), $$(L/r\pi)+(L/R\pi)=N,$$

$$L=rR\times N\pi/(r+R) \tag{1}$$

Herein, the inner diameter r corresponds to the outer diameter of the inner tube of the rotor, and, considering the configuration in which this inner tube is put into the steering shaft, the inner diameter r is same in both rotating connectors illustrated in FIGS. 5A and 5B. In addition, in the rotating connector in FIG. 5A, the outer diameter R corresponds to the inner diameter of the outer tube, however, in the rotating connector in FIG. 5B, the outer diameter R corresponds to the outer diameter of the guiding wall that is smaller than the inner diameter of the outer tube. Therefore it is obvious from the above equation (1) that the outer diameter R of the present embodiment illustrated in FIG. 5B is much smaller than that of the conventional one illustrated in FIG. 5A, the length L of the flat cable 3 can be decreased on condition that the rotation number N of the rotor 2 is constant. For example, supposing the outer diameter of the inner tube is 50 mm, the inner diameter of the outer tube 100 mm, the outer diameter of the guiding wall 70 mm, and the rotation number of the rotor 6, in the case of the conventional rotating connector, L=628 mm can be obtained by inputting r=50 mm, R=100 mm and N=6 to equation (1). On the contrary, in the case of the rotating connector of the present embodiment, L=549.5 mm can be obtained by inputting r=50 mm, R=70 mm and N=6 to equation (1), therefore the length L of the required flat cable 3 can be decreased by 78.5 mm.

Figure 6:
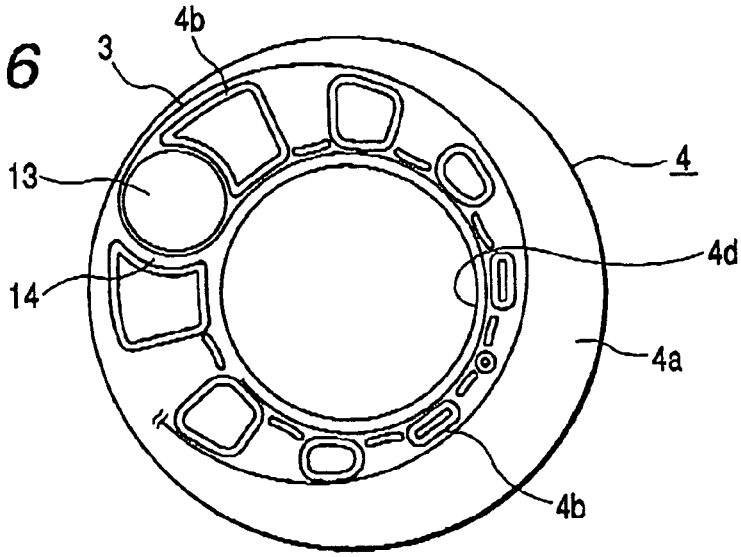
FIG. 6 is a plan view of the holder illustrating the example of a transformed guiding wall.
Figure 7:
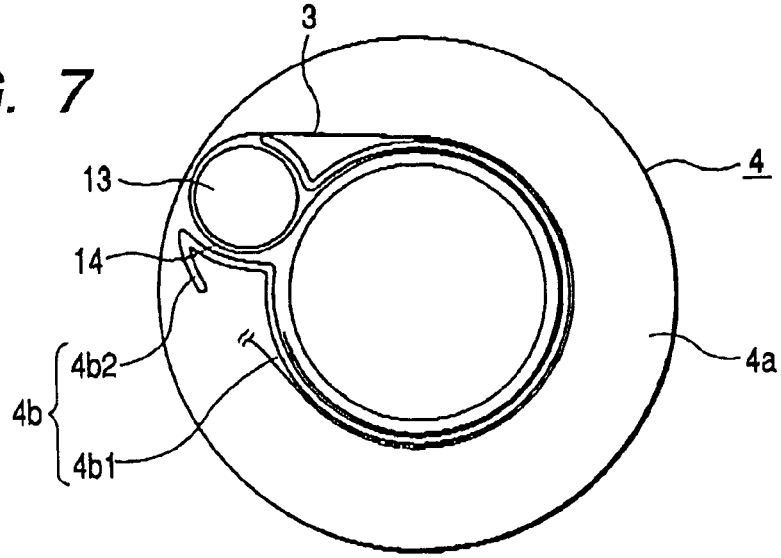
FIG. 7 is a plan view of the holder illustrating the example of a transformed guiding wall.

In addition, in the above-mentioned embodiment, the case the guiding wall 4*b* continuing along the diametric direction is provided on the annular flat plate 4*a* of the holder 4, however, as shown in FIG. 6, separated guiding walls can be sprinkled along the diametric direction, and the flat cable 3 can be wound in a circular shape on the outer circumferential surface of the guiding wall 4*b* and the roller 13 even in this case. In addition, a plotting shape of the outer surface of the guiding wall 4*b* is not limited to a cylinder, as shown in FIG. 7, a non-circular guiding wall is composed of an annular part 4*b*1 and a regulating part 4*b*2 and has such a configuration that most inner tube 7*b* is surrounded by the annular part 4*b*1, and the regulation part 4*b*2 protrudes to both sides of the roller 13 from both ends of the annular part 4*b*1. In this case, the flat cable 3 is wound on the annular part 4*b*1 and the regulating part 4*b*2 of the guiding wall 4*b* and the roller 13 in an egg-shape.

In addition, in the above-mentioned embodiment, the rotating connector using a single piece of flat cable is described. However, needless to say, the present invention can be applied to the double winding type rotating connector that uses two pieces of flat cables.

Figure 8:
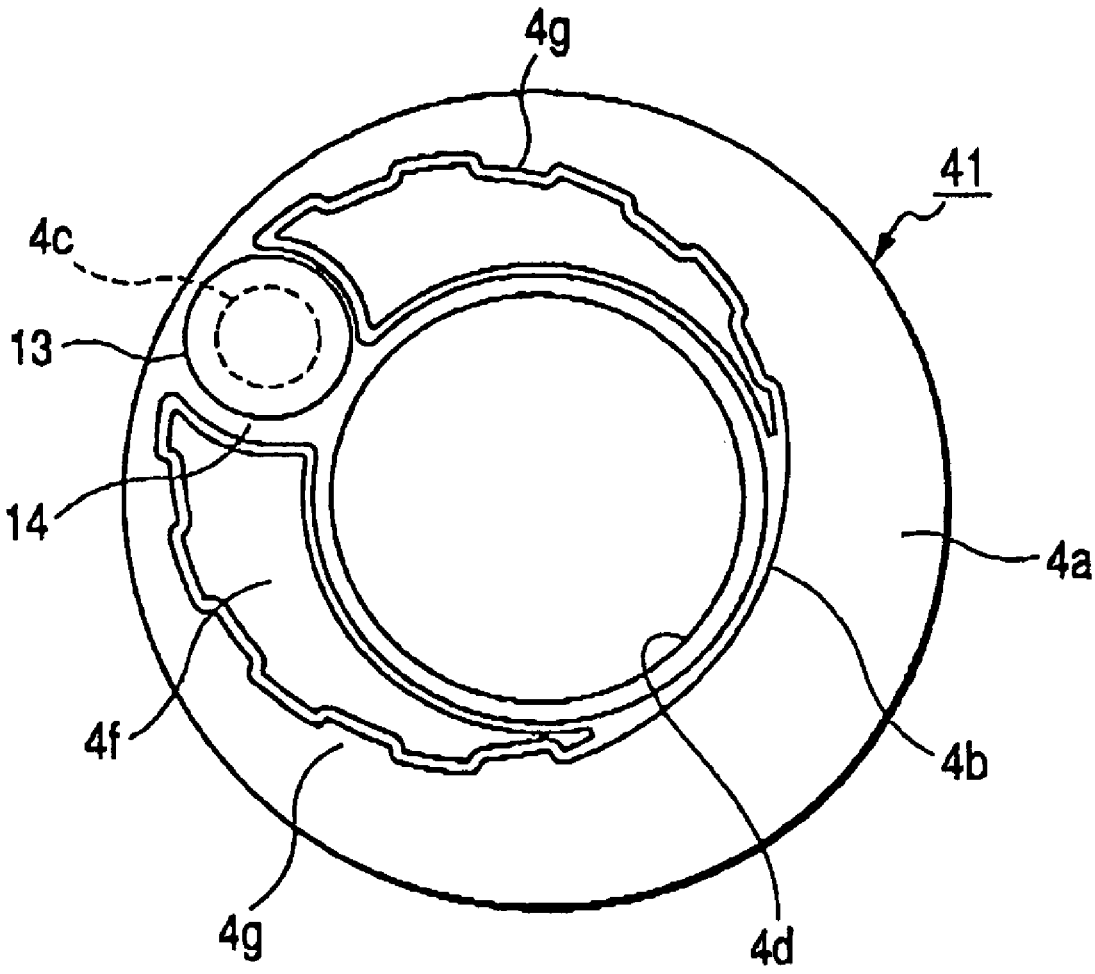
FIG. 8 is a plan view of the holder relating to the second embodiment of the present invention.
Figure 10:
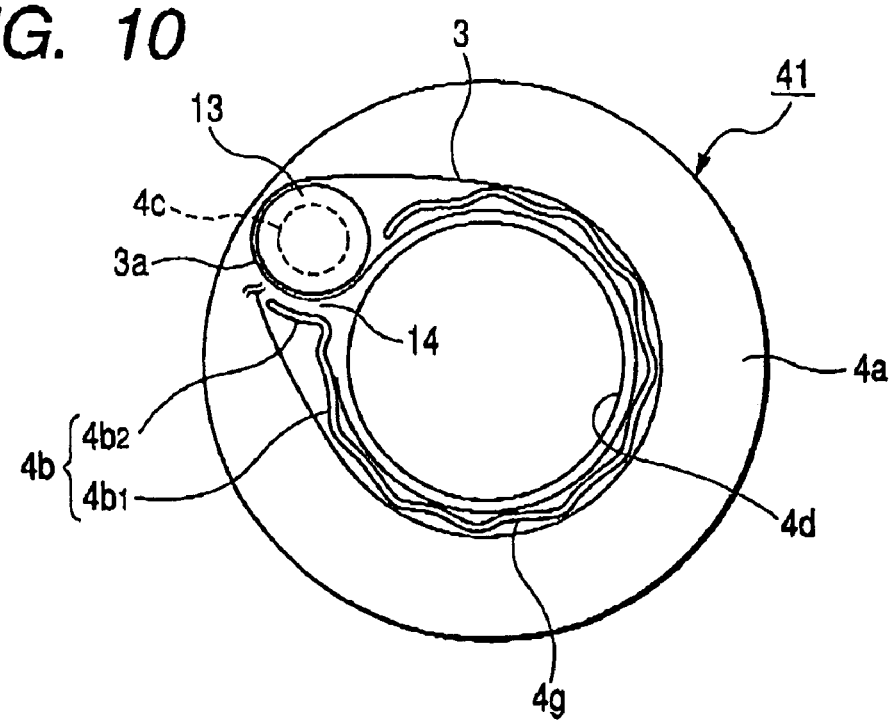
FIG. 10 is a plan view illustrating the example of a transformed holder of the present invention.
Figure 11:
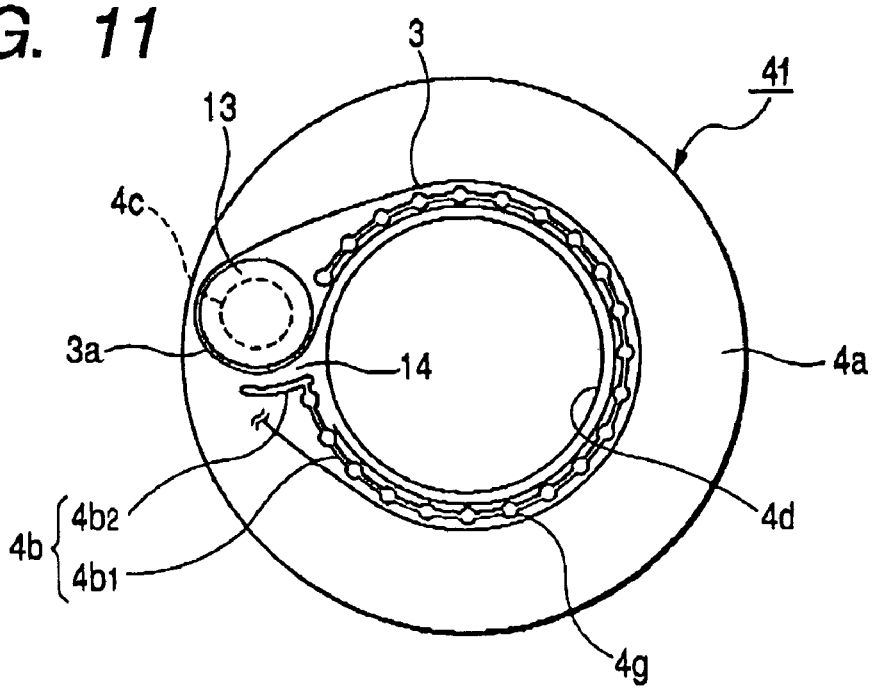
FIG. 11 is a plan view illustrating the example of a transformed holder of the present invention.

Next, a second embodiment according to a third aspect of the present invention will be described with reference to FIGS. 8 to 11. The difference of the second embodiment from the first embodiment is that concavities and convexities are formed on the outer surface of the guiding wall. Therefore, the same members as those of the first embodiment are designated by the same referential numerals, and the description thereof will be omitted. FIG. 8 is a plan view illustrating the holder relating to the second embodiment of the present invention, and FIG. 9 is an explanatory view illustrating the operation of the rotating connector, and FIGS. 10 to 11 are plan views illustrating the modifications of the holder of the present invention.

The guiding wall 4*b* of FIG. 8 is provided on the annular flat plate 4*a* so as to surround most of the guide hole 4*d*, and its inner surface is a circumferential surface almost concentric to the guide hole 4*d*, but its outer surface is a circumferential surface eccentric substantially to the guide hole 4*d*. Between the inner surface and the outer surface of the guiding wall 4*b* is formed a cavity 4*f*, which promotes the reduction in the weight of the holder 41. In addition, concavities and convexities 4*g* are formed on most of the outer surface of the guiding wall 4*b* in a fashion that concavities and convexities are alternatively combined along the circumferential direction. In addition, a part of the guiding wall 4*b* is notched on the annular flat plate 4*a*, and in this notched portion is provided a cylinder-shaped supporting axis 4*c*. The roller 13 is rotatably supported by this supporting axis 4*c*, and the above-mentioned reversing section 3*a* of the flat cable 3 is located in the opening 14 between the roller 13 and the side face of the guiding wall 4*b* facing the roller 13 (see FIG. 9). Therefore the distance from the rotating axis of the rotor 2 to the outer surface of the guiding wall 4*b* becomes the maximum in the vicinity of the opening 14 where the roller is supported, and becomes the minimum in the location that is opposite to the roller 13.

Figure 9A:
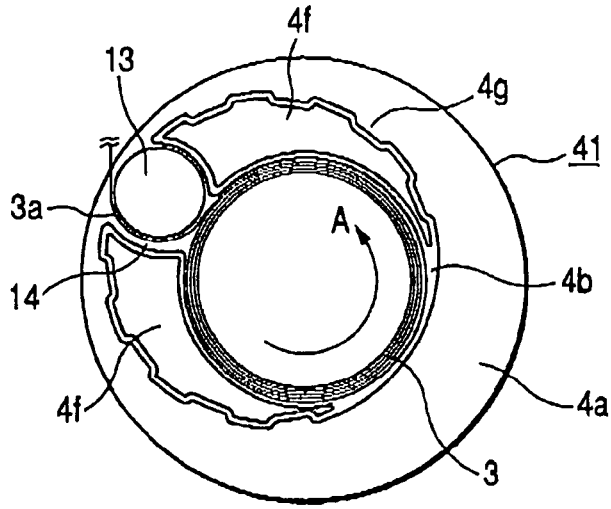
FIG. 9 is an explanatory view illustrating the operation of the rotating connector comprising the holder relating to the second embodiment of the present invention.
Figure 9B:
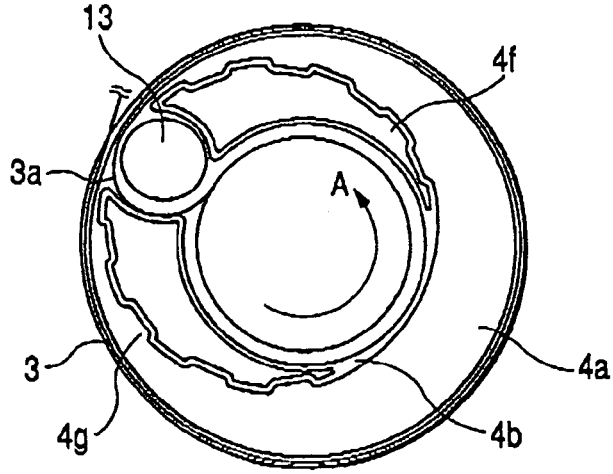
Figure 9C:
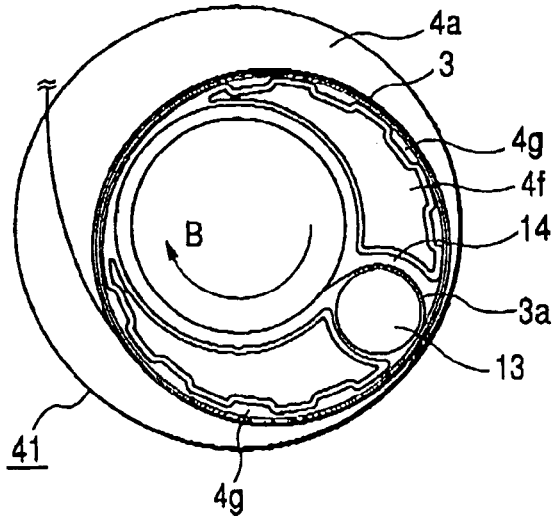

As shown in FIG. 9, in the middle of the transition between the wound-tight state shown in FIG. 9A and the wound-back state shown in FIG. 9B, the flat cable 3 is once unreeled to the outer tube 5*a* located in the outside of the guiding wall 4*b* the holder 41, as shown in FIG. 9B, but it is wound on the outer surface of the guiding wall 4*b* of the holder 4 arranged in the annular space in the wound-back state, and the diameter of the outer surface of the guiding wall 4*b* is much smaller than that of the inner circumferential surface of the outer tube 5*a*, thus the length of the required flat cable 3 can be decreased substantially. In addition, the concavities and convexities reducing the contact area with the flat cable 3 are formed on the outer surface of the guiding wall 4*b* of the holder 41, thus the flat cable 3 can be unreeled smoothly with no adherence to the outer surface of the guiding wall 4*b* in the wound-tight operation in which the flat cable 3 is unreeled from the outer surface of the guiding wall 4*b*, and finally the rotor 2 or the holder 41 can be rotated smoothly. Particularly, the flat cable 3 can be unreeled smoothly from the outer surface of the guiding wall 4*b* in the wound-tight operation even when a lubricant such as grease, etc., is filled up in the sliding area between the stator 1 and the movable members such as the rotor 2 or the holder 4 and flows out to the outer surface of the guiding wall 4*b*. In addition, in the case of the present embodiment, the concavities and convexities 4*g* are not formed on the minimum diameter part of the outer surface of the guiding wall 4*b*, they may be formed along all the outer surface of the guiding wall 4*b*, and may be formed on the inner surface of the guiding wall 4*b* in the same pattern.

In addition, the shape of the guiding wall 4*b* is not limited thereto; what is necessary is the distance from the rotating axis of the rotor 2 to the outer surface of the guiding wall 4*b* becomes the maximum in the vicinity of the opening 14. For example, if the guiding wall 4*b* is composed of the annular part $\mathbf{4}b_1$ and the regulating part $\mathbf{4}b_2$ and is non-circularly shaped, as shown in FIGS. 10 to 11, and the flat cable 3 is wound on this guiding wall 4*b* and the roller 13 in an egg-shape, the weight of the holder 41 can be further reduced. In this case, the annular part $\mathbf{4}b_1$ extends in the circumferential direction to surround most of the guide hole 4*d*, and the regulating part $\mathbf{4}b_2$ extends outward in the diametric direction from one end of the annular part $\mathbf{4}b_1$, and the roller 13 faces the regulating part $\mathbf{4}b_2$ through the opening 14.

In addition, the shape and the location of the concavities and convexities 4*g* formed on the guiding wall 4*b* are not limited thereto, as shown in FIG. 10, the annular part $\mathbf{4}b_1$ may be shaped like a wave, or, as shown in FIG. 11, a number of cylindrical convexities may be formed on the annular part $\mathbf{4}b_1$ at regular intervals, or, even though not shown, a number of hemispheric convexities may be sprinkled on the outer surface of the guiding wall 4*b*; what is necessary is that the concavities and convexities 4*g* reducing the contact area with the flat cable 3 are formed on the outer surface of the guiding wall 4*b*.

Figure 12:
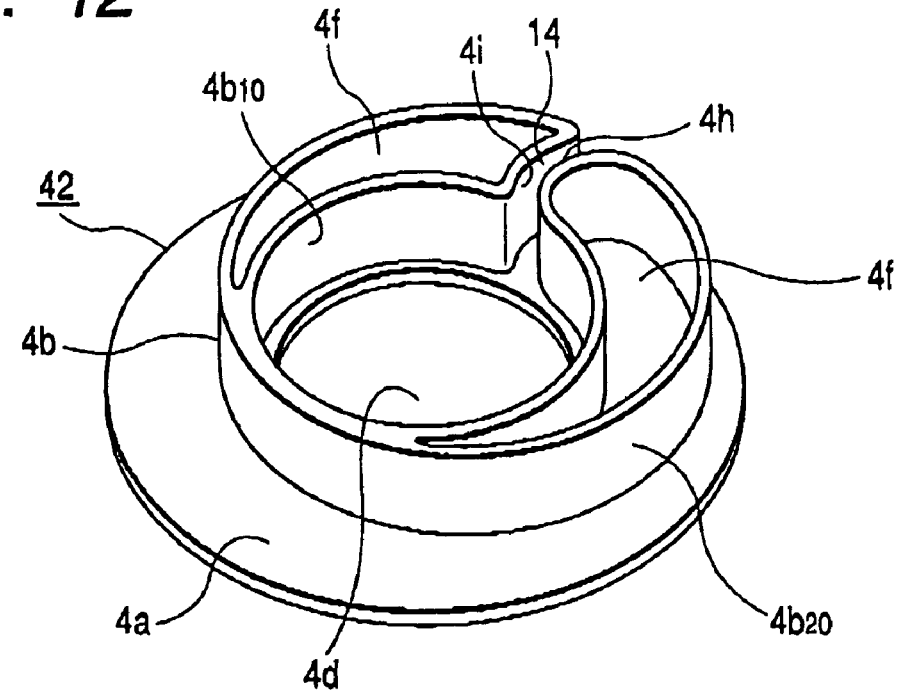
FIG. 12 is a perspective view of the holder relating to the third embodiment of the present invention.

Next, a third embodiment according to a fourth aspect of the present invention will be described with reference to FIG. 12. The difference of the third embodiment from the first embodiment is that the roller 13 is not provided, and the concave wall and the convex wall are shaped as one body in the guiding wall with the opening between them. Therefore the same members as those of the first embodiment are designated by the same referential numerals, and the description thereof will be omitted. FIG. 12 is a perspective view illustrating the holder relating to the third embodiment of the present invention.

In the holder 42 of FIG. 12, the above-mentioned inverting section 3*a* of the flat cable 3 is located in the opening 14, and the convex wall 4*h* faces the inner surface of the inverting section 3*a*, and the concave wall 4*i* faces the outer surface of the inverting section 3*a*. In addition, protrusions are formed on the lower face of the annular flat plate 4*a* to reduce the sliding friction with the lower plate 6*a*, and also a cavity 4*f* is formed between the inner circumferential surface $\mathbf{4}b_{10}$ and the outer circumferential surface $\mathbf{4}b_{20}$ of the guiding wall 4*b* to reduce the weight of the holder 42.

Figure 13:
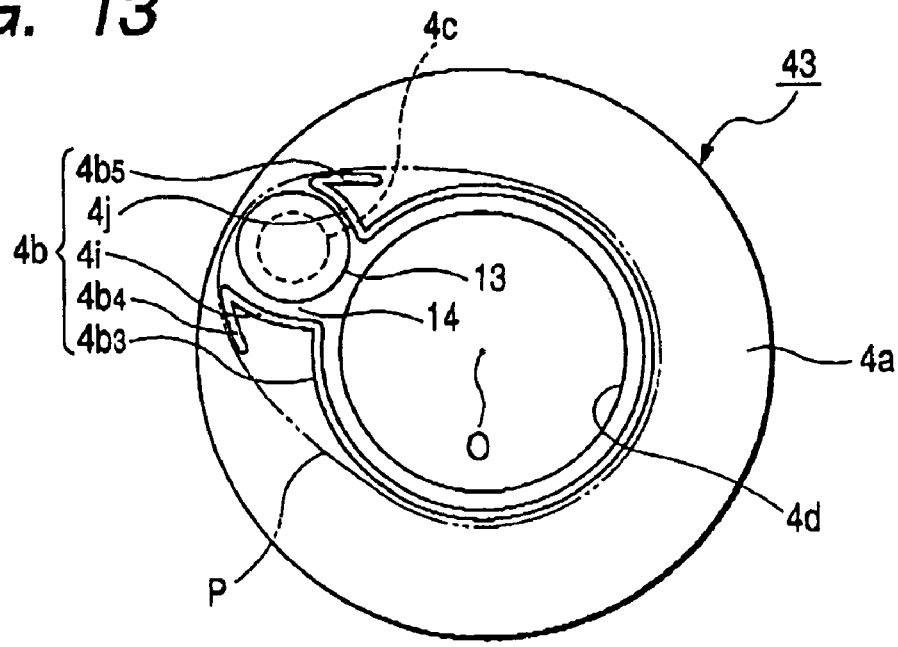
FIG. 13 is a plan view of the holder relating to the fourth embodiment of the present invention.

Next, a fourth embodiment according to a fifth aspect of the present invention will be described with reference to FIG. 13. The difference of the fourth embodiment from the first embodiment is that the guiding wall comprises a coupling wall portion, an inner wall portion and an outer wall portion. Therefore, the same members as those of the first embodiment are designated by the same referential numerals, and the description thereof will be omitted. FIG. 13 is a plan view illustrating the holder relating to the fourth embodiment of the present invention.

As shown in FIG. 13, the guiding wall 4*b* of the holder 43 comprises an inner wall $\mathbf{4}b_3$ as an inner wall portion annularly extending to surround most of the center hole 4*d*, a concave wall 4*i* as a coupling wall portion and an opposing wall 4*h* extending to the outer edge of the annular flat plate 4*a* from both ends of the inner wall $\mathbf{4}b_3$, and a first and second outer walls $\mathbf{4}b_4$, $\mathbf{4}b_5$ as an outer wall portion extending to the inner wall $\mathbf{4}b_3$ from the outer end of the concave wall 41 and the opposing wall 4*i*. These are formed continuously with almost same thickness. The concave wall 4*i* and the opposing wall 4*h* face to each other through the supporting axis 4*c*, and the roller 13 is rotatably supported by this supporting axis 4*c*. The above-mentioned intermediate reversing section of the flat cable 3 is located in the opening 14 secured between the roller 13 and the concave wall 4*i* facing the roller 13, and the flat cable 3 is wound non-circularly on the inner wall $4b_1$ and the outer surface of the first and the second outer walls $4b_4$, $4b_5$ when it slides to the outer tube 5*b* from the inner tube 7*b* through the opening 14. When the route of the flat cable becomes the non-circular one P, the distance from the center O of the guide hole 4*d* (i.e. the rotating axis of the rotor 2) to the non-circular route P becomes the maximum in the vicinity of the opening 14 where the roller 13 is supported, and becomes smaller along the extending direction of the first and the second outer walls $4b_4$, $4b_5$, and becomes the minimum in the location that is opposite to the roller 13.

Figure 14:
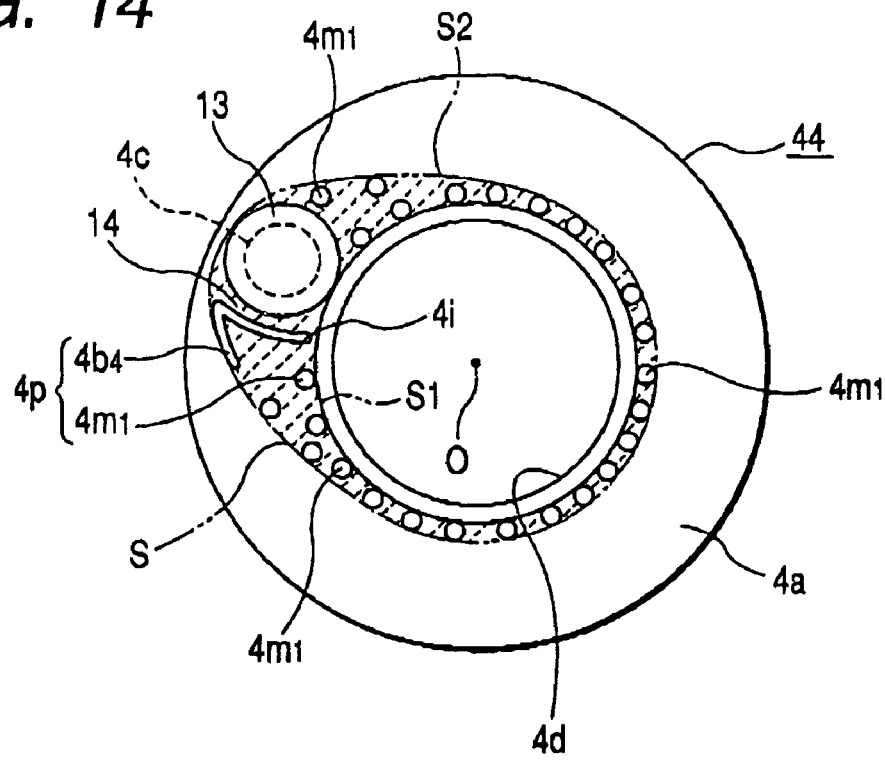
FIG. 14 is a plan view of the holder relating to the fifth embodiment of the present invention.

Next, a fifth embodiment according to a sixth aspect of the present invention will be described with reference to FIGS. 14 to 15. The difference of the fifth embodiment from the first embodiment is that a plurality of columns are provided instead of the guiding wall. Therefore, the same members as those of the first embodiment are designated by the same referential numerals, and the description thereof will be omitted. FIG. 14 is a plan view illustrating the holder relating to the fifth embodiment of the present invention, and FIG. 15 is a perspective view illustrating the example of a transformed holder.

As shown in FIG. 14, the guide portion 4*p* of the holder 44 comprises a number of cylindrical guide pins $4m_1$; and a concave wall 4*i* and outer wall $4b_4$ shaped like a wedge, and the above-mentioned supporting axis 4*c* and guide pins $4m_1$ are provided on the non-circular area S surrounding the guide hole 4*d* on the annular flat plate 4*a* at certain intervals. Herein, the inner edge of the non-circular area S has a circular path S1 concentric to the guide hole 4*d*, but the outer edge of the non-circular area S has a non-circular path S2 not concentric to the guide hole 4*d*, shaped like an egg, and most of the guide pins $4m_1$ are provided along the circular path S1, and the rest of the guide pins $4m_1$ are provided along the non-circular path S2. In addition, the concave wall 4*i* extends from the circular path S1 to the outer edge of the annular flat plate 4*a*, and the outer wall $4b_4$ extends along the non-circular path S2 from the outer end of the concave wall 4*i*, and the supporting axis 4*c* faces the concave wall 4*i* with a certain distance between them. The roller 13 is rotatably supported by this supporting axis 4*c*, and the above-mentioned inverting section 3*a* of the flat cable 3 is located in the opening 14 secured between the roller 13 and the concave wall 4*i* facing the roller 13. And, the flat cable 3 that slides to the outer tube 5*a* from the inner tube 7*b* through the opening 14 is wound non-circularly on the outer wall $4b_4$ and the guide pins $4m_1$ provided along the non-circular path S2. Therefore the distance from the center O of the guide hole 4*d* (i.e. the rotating axis of the rotor 2) to the non-circular path S2 becomes the maximum in the vicinity of the opening 14 where the roller 13 is supported, and becomes smaller away from the opening 14, and becomes the minimum in the location that is opposite to the roller 13.

Figure 15:
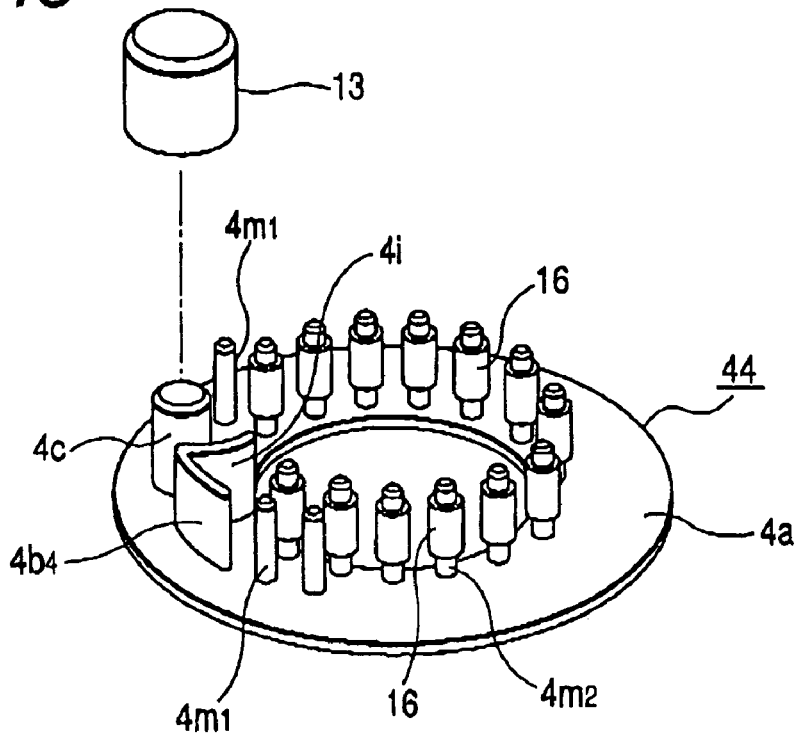
FIG. 15 is a perspective view illustrating the example of a transformed holder of the present invention.

FIG. 15 is a perspective view illustrating the example of a transformed holder 44, and as shown in this figure, this holder 44 has small-diameter rollers 16 rotatably supported by the guide pins $4m_1$ as well as the roller 13 rotatably supported by the supporting axis 4*c*. Such a configuration can decrease the friction between the guide pins 4*m*1 and the flat cable 3, thus the flat cable 3 can be wound tight or back smoothly when the rotor 2 rotates. In addition, it is not necessary that all the guide pins $4m_1$ support the rollers 16, the rollers 16 may not be supported by the guide pins $4m_1$ on which the flat cable 3 rarely slides. In addition, instead of the roller 16, the holder 44 may be formed with lubricative synthetic resin or lubricative materials may be adhered on the outer surface of the guide pins $4m_1$.

In addition, in the above-mentioned embodiment, the guide portion 4*p* composed of a number of cylindrical guide pins 4*m*1 and the concave wall 4*i* and the outer wall $4b_4$ shaped like a wedge is described, if a plurality of guide pins 4*m*1 are provided on the location corresponding to the outer wall $4b_4$, the guide portion 4*p* can be composed of guiding pins 4*m*1 having an identical shape.

Figure 16:
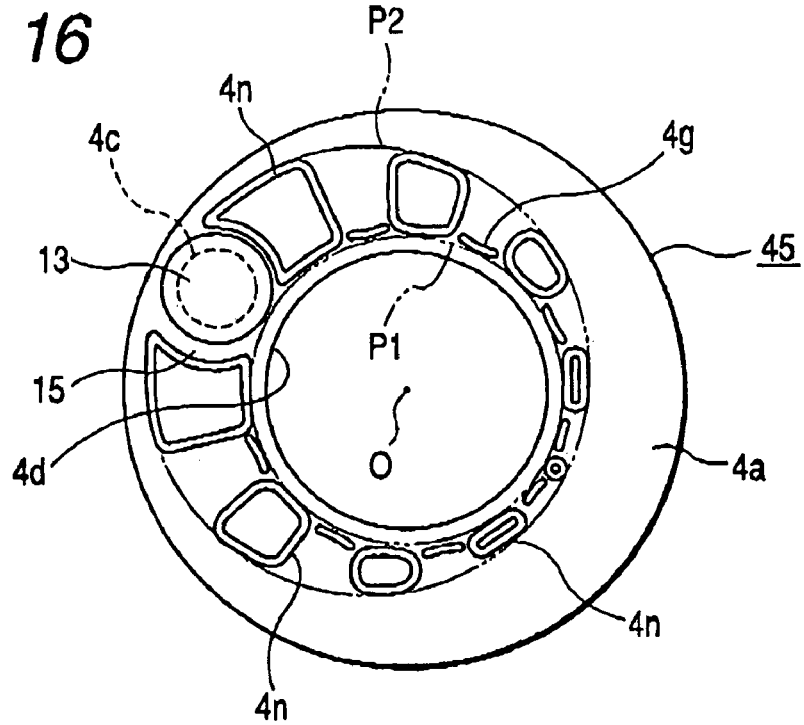
FIG. 16 is a plan view of the holder relating to the sixth embodiment of the present invention.

Next, a sixth embodiment according to a seventh aspect of the present invention will be described with reference to FIG. 16. The difference of the sixth embodiment from the first embodiment is that the guiding wall is a hollow tube-shaped wall. Therefore, the same members as those of the first embodiment are designated by the same referential numerals, and the description thereof will be omitted. FIG. 16 is a plan view illustrating the holder of the sixth embodiment of the present invention.

Hollow tube-shaped walls 4*n* shown in FIG. 16 are arranged at certain intervals to surround the guide hole 4*d* of the annular flat plate 4*a*, and complementary walls 4*g* are arranged in the circumferential direction between a pair of adjacent hollow tube-shaped walls 4*n*. As shown in FIG. 16, when the imaginary inner circumferential surface joining the inner side of the hollow tube-shaped walls 4*n* is represented with P1, the center O of this imaginary inner circumferential surface P1 corresponds to the center O of the guide hole 4*d* (i.e. the center of the inner tube 7*b*), each complementary wall 4*q* is arranged on the imaginary inner circumferential surface P1. However, when the imaginary outer circumferential surface joining the outer side of the hollow tube-shaped walls 4*n* is represented with P2, the center of this imaginary outer circumferential surface P2 is eccentric to the center 0 of the guide hole 4*d* (the center of the inner tube 7*b*), the supporting axis 4*c* is provided in the location that the diameter of the imaginary outer circumferential surface P2 becomes the maximum (the location that the distance to the center O becomes the maximum). The roller 13 is rotatably supported by this supporting axis 4*c*, and the reversing section 3*a* of the flat cable 3 is located in the opening between the roller 13 and the hollow tube-shaped wall 4n facing the roller 13. Therefore the distance from the rotating axis of the rotor 2 to the imaginary outer circumferential surface P2 joining the outer side of the hollow tube-shaped walls 4n becomes the maximum in the vicinity of the opening 14, and becomes the minimum in the location that is opposite to the roller 13.

Figure 17:
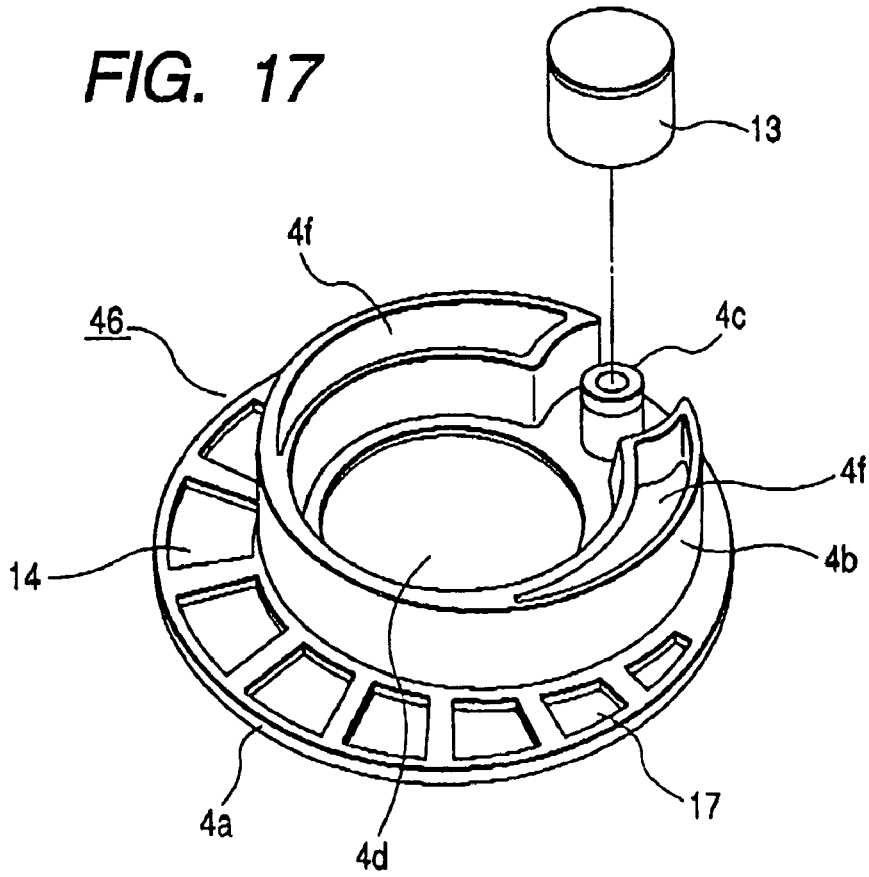
FIG. 17 is a perspective view of the holder relating to the seventh embodiment of the present invention.

Next, a seventh embodiment according to an eighth aspect of the present invention will be described with reference to FIGS. 17 to 18. The difference of the seventh embodiment from the first embodiment is that cavities and/or synthetic resin-removed parts are formed in the holder. Therefore, the same members as those of the first embodiment are designated by the same referential numerals, and the description thereof will be omitted. FIG. 17 is a perspective view illustrating the holder of the seventh embodiment of the present invention, and FIG. 18 is a perspective view illustrating the example of a transformed holder of the present invention.

In the holder 46 shown in FIG. 17, both holes 17 formed on the annular flat plate 4*a* and cavities 4*f* formed in the guiding wall 4*b* function as a synthetic resin removed part, thus the passing holes 17 and the synthetic resin removed part can reduce the weight of the holder 46.

Figure 18:
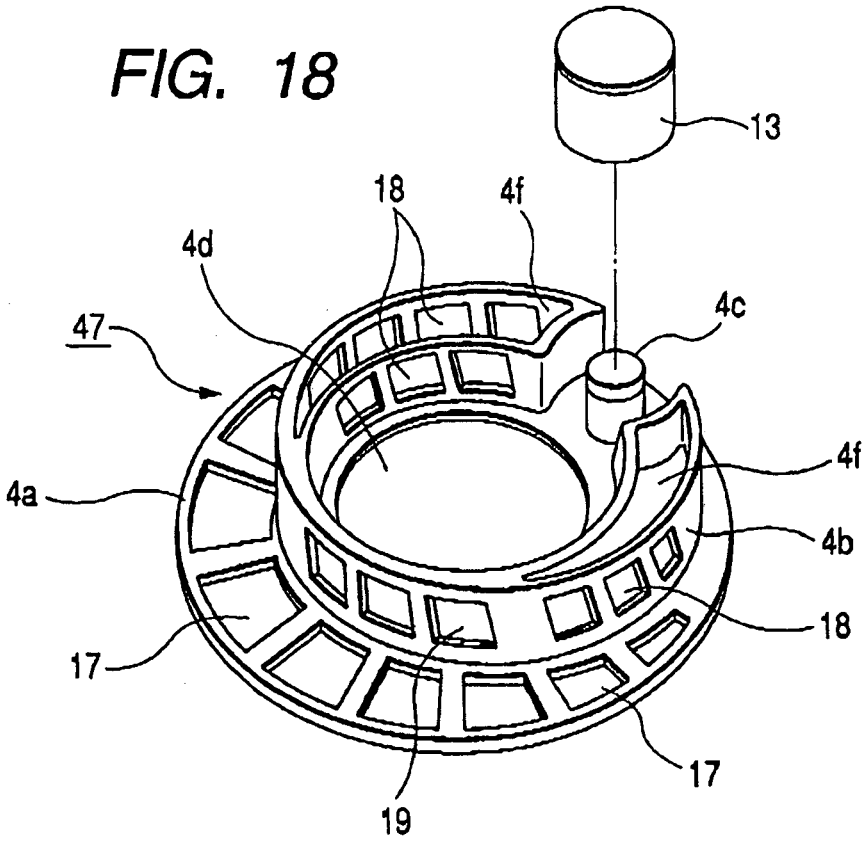
FIG. 18 is a perspective view illustrating the example of a transformed holder of the present invention.

To the holder 47 of FIG. 18 are added a plurality of holes 18 functioning as the synthetic resin removed part. These holes are formed to penetrate the inner surface and the outer surface of the guiding wall 4*b*, thus part of each hole 18 is connected with the cavity 45. As above, the cavities 45 and the holes 18 are formed on the guiding wall 4*b* as well as the passing hole 17 formed on the annular flat plate 4*a*, thus these three kinds of synthetic resin removes parts can further reduce the weight of the holder 47.

Figure 19:
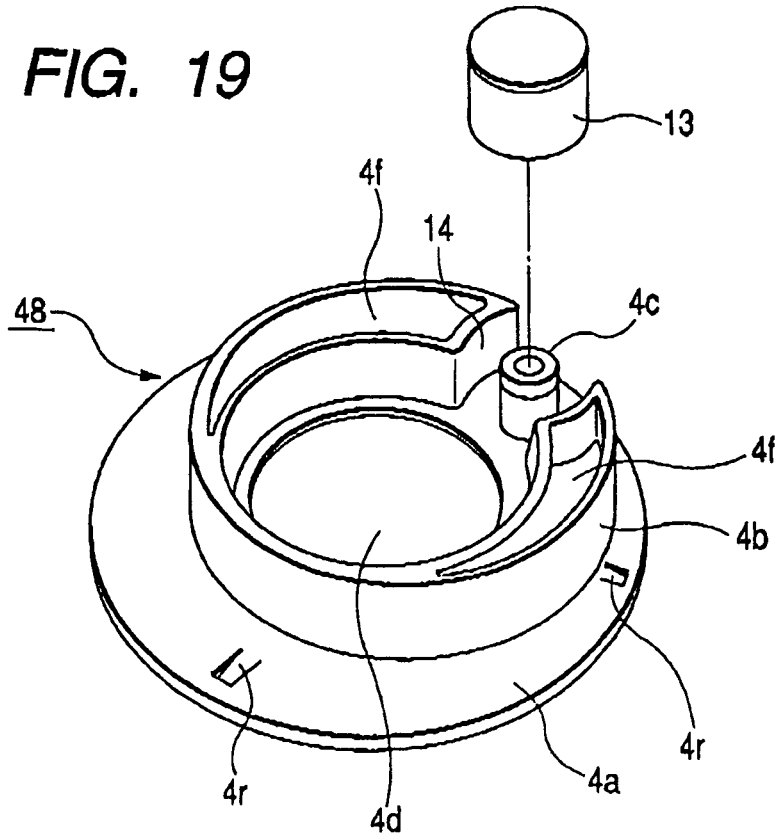
FIG. 19 is a perspective view of the holder relating to the eighth embodiment of the present invention.

Next, an eighth embodiment according to a ninth aspect of the present invention will be described with reference to FIGS. 19 to 20. The difference of the eighth embodiment from the first embodiment is that, instead of the protrusions, first reslient urging elements are provided on the lower face of the annular flat plate. Therefore, the same members as those of the first embodiment are designated by the same referential numerals, and the description thereof will be omitted. FIG. 19 is a perspective view illustrating the holder of the eighth embodiment of the present invention, and FIG. 20 is a cross sectional view illustrating the rotating connector comprising the holder of the present invention.

The holder 48 comprises an annular flat plate 4*a* loaded on the lower plate 6*a* of the cover 6; a guiding wall 4*b* and a supporting axis 4*c* provided on this annular flat plate 4*a*, and these members are shaped as one body with a synthetic resin. The annular flat plate 4*a* has an outer diameter almost the same as the inner diameter of the outer tube 5*a*, and a plurality of resilient tongues 4*r* as the first resilient urging element are shaped as one body in a cantilevered crossbeam shape on the annular flat plate 4*a*. These resilient tongues 4*r* are formed along the circumferential direction of the annular flat plate 4*a*, and at least more than 3 pieces are arranged, for example, at 120-degree intervals, and the front end (free end) extends downward obliquely from the annular flat plate 4*a* and forms a hemispheric curved face. These curved faces of the resilient tongues 4*r* are in contact with the upper face of the lower plate 6*a* elastically, and the upper end of the guiding wall 4*b* is pushed upward to the lower face of the upper plate 7*a* with the repulsive force (see FIG. 20). In addition, on the center of the annular flat plate 4*a* is formed an annular guide hole 4*d*, and this guide hole 4*d* is put into the lower outer circumferential surface of the inner tube 7*b*, and thus the holder 48 slides on the inner tube 7*b*, and can rotate in the annular space 9.

The guiding wall 4*b* of the holder 48 is provided on the annular flat plate 4*a* to surround most of the guide hole 4*d*, and the inner surface of the guiding wall 4*b* is almost concentric to the guide hole 4*d*, but the outer surface of the guiding wall 4*b* is substantially eccentric to the guide hole 4*d*. In addition, part of the guiding wall 4*b* is removed on the annular flat plate 4*a*, and the cylindrical supporting axis 4*c* is supported by the removed part of the guiding wall 4*b*. The roller 13 is rotatably supported by this supporting axis 4*c*, and the above-mentioned reversing section 3*a* of the flat cable 3 is located in the opening 14 between the roller 13 and the side face of the guiding wall 4*b* facing the roller 13. Therefore the distance from the rotating axis of the rotor 2 to the outer surface of the guiding wall 4*b* becomes the maximum in the vicinity of the opening 14 where the roller 13 is supported, and becomes the minimum in the location that is opposite to the roller 13. In addition, concave cavities 4*f* are formed between the inner surface and the outer surface of the guiding wall 4*b*, thus the weight of the holder 48 can be reduced.

Figure 20:
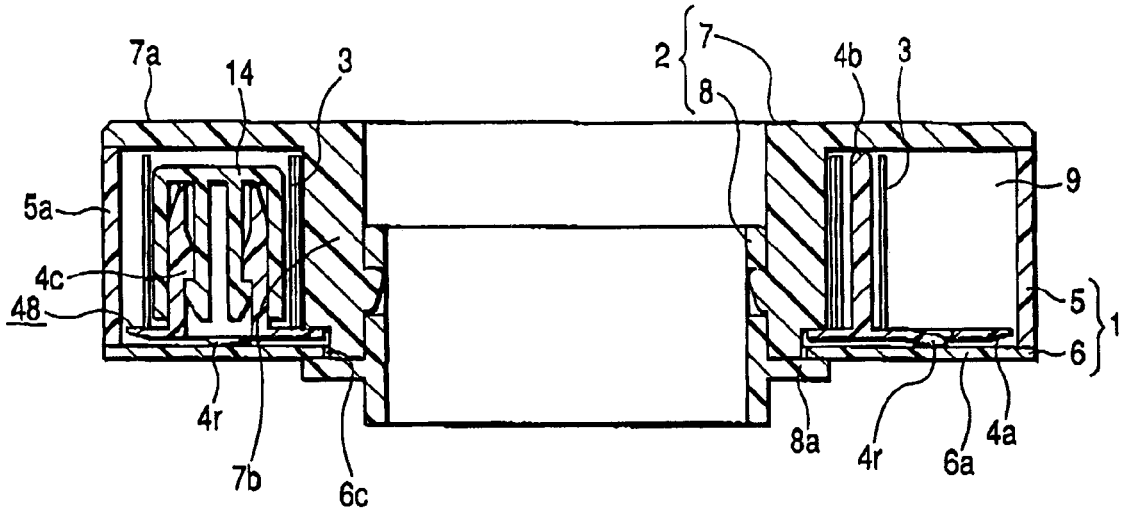
FIG. 20 is a cross sectional view of the rotating connector comprising the holder relating to the eighth embodiment of the present invention.

As mentioned above, a plurality of resilient tongues 4*r* are formed as one-body on the annular flat plate 4*a* of the holder 48, the curved faces in the free ends of the resilient tongues 4*r* are in contact with the upper face of the lower plate 6*a* elastically, and the upper end of the guiding wall 4*b* is pushed upward to the lower face of the upper plate 7*a*, thus the holder 48 is restrained from moving up and down in the annular space 9 with the resilient urging force of the resilient tongues 4*r* even when the vibration in the rotating axis direction of the rotor 2 is applied externally, and, consequently, the collision of the holder 4 with the upper plate 7*a* or the lower plate 6*a* can be prevented, and thus the occurrence of noise due to the collision can be decreased (see FIG. 20).

Figure 21:
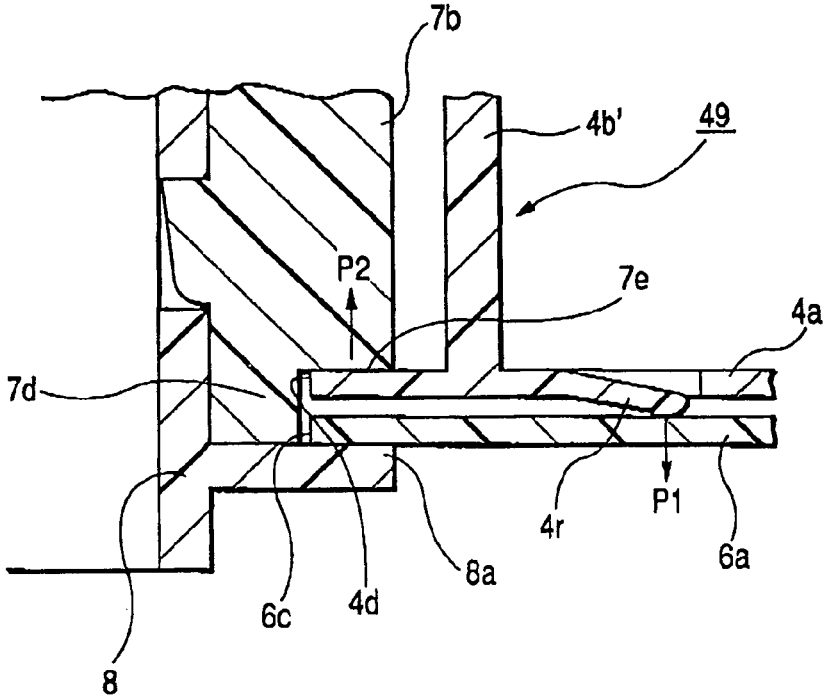
FIG. 21 is an explanatory view of the engaging part of the rotor and the holder relating to the ninth embodiment of the present invention.
Figure 22:
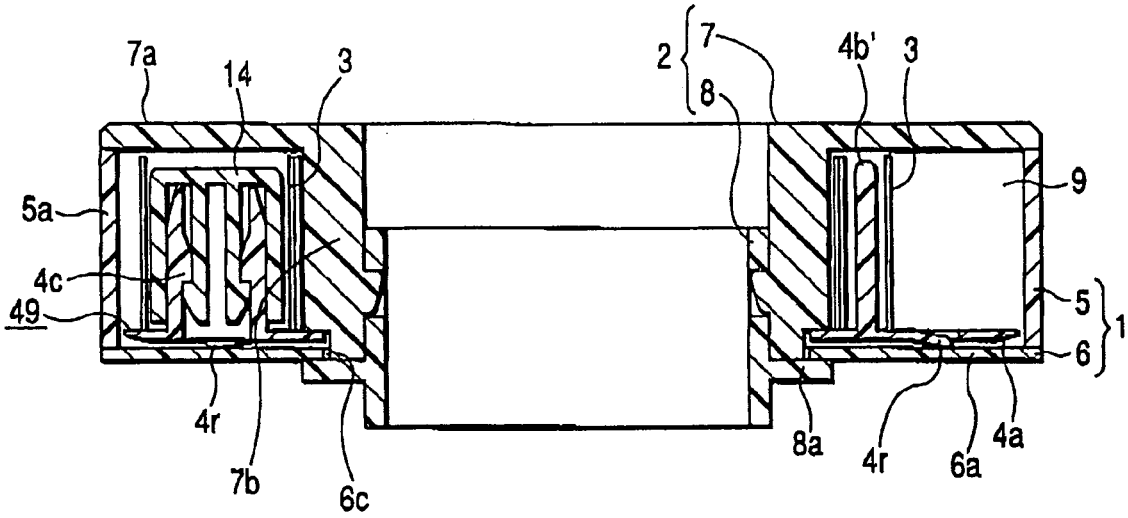
FIG. 22 is a cross sectional view of the rotating connector comprising the holder of the present invention.

Next, a ninth embodiment according to a tenth aspect of the present invention will be described with reference to FIGS. 21 to 22. The difference of the ninth embodiment from the first embodiment is that a second resilient urging element are provided on the lower face of the annular flat plate instead of the protrusions, and the guiding wall 4*b* is formed so low that it can not reach the lower face of the upper plate. Therefore, the same members as those of the first embodiment are designated by the same referential numerals, and the description thereof will be omitted. FIG. 21 is an explanatory view illustrating the engaging part of the rotor and the holder of the ninth embodiment of the present invention, and FIG. 22 is a cross sectional view illustrating the rotating connector comprising the holder of the present invention.

The rotor 2 is a movable member coupled to a handle, and comprised the upper rotor 7 and the lower rotor 8. The upper rotor 7 comprises the annular upper plate 7*a* and the inner tube 7*b* extending downwards from the center of the upper plate 7*a*, and the upper containing element 7*c* is provided on the upper face of the upper plate 7*a*, and the inner tube is a hollow element having the inner diameter large enough to be put into the steering shaft. As shown in FIG. 21, the lower end of the inner tube 7*b* forms the small-diameter part 7*d*, and the inner tube 7*b* and the small-diameter part 7*d* are connected through the stepped part 7*e*. The outer diameter of the inner tube 7*b* is set a little larger than that of the center hole 6*c* of the lower plate 6*a*, but the outer diameter of the small-diameter part 7*d* is set a little smaller than that of the center hole 6*c*. On the other hand, the lower rotor 8 is a tube-shaped element having a guarding member 8*a*, and is inserted through the center hole 6*c* of the cover 6 to and snap-coupled with the inner surface of the inner tube 7*b*, thus the rotor 2 is rotatably coupled to the stator 1. And, in such a coupling state, the outer tube 5*a* and the lower plate 6*a* of the stator 1 and the inner tube 7*b* and the upper plate 7*a* of the rotor 2 define the ring-shaped annular space 9.

The holder 49 of FIG. 21 comprises the annular flat plate 4*a* loaded on the lower plate 6*a* of the cover 6; and the guiding wall 4*b* and the supporting axis 4*c* provided on this annular flat plate 4*a*, and these elements are formed as one body with synthetic resin. The annular flat plate 4*a* has the outer diameter almost the same as the inner diameter of the outer tube 5*a*, and a plurality of resilient tongues 4*r* as the second resilient urging element are shaped as one body like a cantilevered crossbeam in this annular flat plate 4*a*. These elastic tiny pieces 4*r* are formed along the circumferential direction of the annular flat plate 4*a*, and at least three pieces are formed at regular intervals. In the case of the present embodiment, three resilient tongues 4*r* are formed on the annular flat plate 4*a* at 120-degree intervals, and the front ends (free end) of the resilient tongues 4*r* extend downward obliquely from the annular flat plate 4*a*, and forms a hemispheric curved face. In addition, on the center of the annular flat plate 4*a* is drilled a circular guide hole 4*d*, and this guide hole 4*d* is put into the stepped-part 7*e* through the small-diameter part 7*d* of the upper rotor 7, thus the holder 49 can rotate around the inner tube in the annular space 9. In this case, as shown in FIG. 21, the annular flat plate 4*a* and the lower plate 6*a* are put in between the stepped part 7*e* of the upper rotor 7 and the guarding part 8*a* of the lower rotor 8, the resilient tongues 4*r* of the curved face are in contact with the upper face of the lower plate 6*a* with the force of P1, thus the repulsive force P2 of P1 exerts upward, and then the circumferential edge of the guide hole 4*d* is pushed and contacted to the stepped part 7*e* with the force of P2.

As above, in the rotating connector relating to the present embodiment, in the rotor 2 is formed the small-diameter part 7*d* connected to the inner tube 7*b* through the stepped part 7*e*, and the front ends of the resilient tongues 4*r* shaped as one body on the annular flat plate 4*a* of the holder 4 is in contact with the upper face of the lower plate 6*a* resiliently, thus the circumferential edge of the guide hole 4*d* put into the small-diameter part 7*d* is pushed and contacted to the stepped part 7*e* with the repulsive force from the resilient tongues 4*r*, thus the holder is restrained from moving up and down in the annular space 9 even when the vibration in the rotating axis direction of the rotor 2 is applied from the externally, and the occurrence of noise due to the collision of the holder 4 with the upper plate 7*a* or the lower plate 6*a* can be decreased.

In addition, in the present embodiment, the guiding wall 4*b*' is formed lower than the guiding wall 4*b* of FIG. 20, thus, as shown in FIG. 20, even when the resilient tongues 4*r* are in contact with the upper face of the lower plate 6*a* resiliently with the force of P1 and the repulsive force P2 of P1 exerts upward, and the circumferential edge of the guide hole 4*d* is pushed and contacted to the stepped part 7*e* with the force of P2, the guiding wall 4*b*' can not reach the lower face of the upper plate 7*a*.

Figure 23:
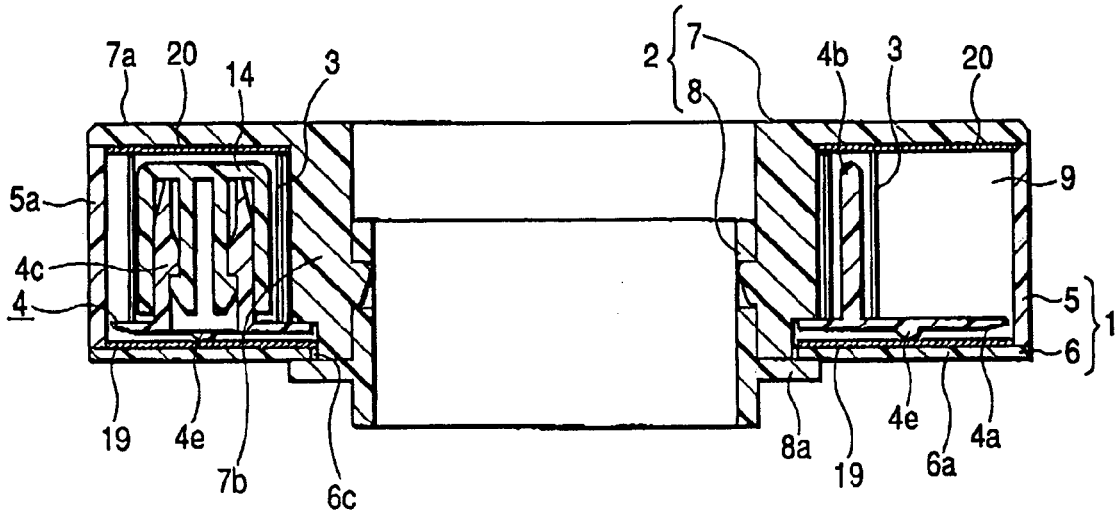
FIG. 23 is a cross sectional view of the rotating connector relating to the tenth embodiment of the present invention.

Next, a tenth embodiment according to an eleventh aspect of the present invention will be described with reference to FIG. 23. The difference of the tenth embodiment from the first embodiment is that lubricative sheets are provided between the holder 4 and the lower plate 6*a*. Therefore, the same members as those of the first embodiment are designated by the same referential numerals, and the description thereof will be omitted. FIG. 23 is a cross sectional view illustrating the rotating connector of the tenth embodiment of the present invention.

In FIG. 23, on the upper face of the lower plate 6*a* located at the lower opening end of the annular space 9 is adhered a first lubricative sheet 19, and on the lower face of the upper plate 7*a* located at the upper opening end of the annular space 9 is adhered a second lubricative sheet 20. The first and the second lubricative sheets are made of synthetic resin such as polytetrafluoroethylene (PTFE) having an excellent lubricancy, in the case of the present embodiment, these lubricative sheets 19, 20 are directly adhered on the lower plate 6*a* and the upper plate 7*a*, but the lubricative sheets may be adhered on the upper plate 6*a* and the lower plate 7*a* through sheet-shaped elastic members such as sponges etc.

The protrusions 4*e* of the holder 50 of FIG. 23 slide on the upper face of the first lubricative sheet 10.

As above, in the rotating connector relating to the present embodiment, the first sheet 19 is adhered on the lower plate 6*a* facing the annular flat plate 4*a* of the holder 4, thus the holder 4 slides on the first lubricative sheet 19 and rotates in the annular space 9 in the wound-tight or back operation, the sliding noise from the contact area between the holder 4 and the lower plate 6*a* can be decreased. In addition, a plurality of protrusions 4*e* are formed on the lower face of the annular flat plate 4*a*, thus the sliding noise between the holder 50 and the first lubricative sheet 19 is decreased substantially, and the holder 4 can rotate smoothly. In addition, the second lubricative sheet 20 is adhered on the lower face of the upper plate 7*a* located at the upper opening end of the annular space 9, thus the flat cable 3 is in contact with the second lubricative sheet in the wound-tight or back operation, and the sliding noise arising from the contact area between the flat cable 3 and the upper plate 7*a* can be decreased.

Figure 24:
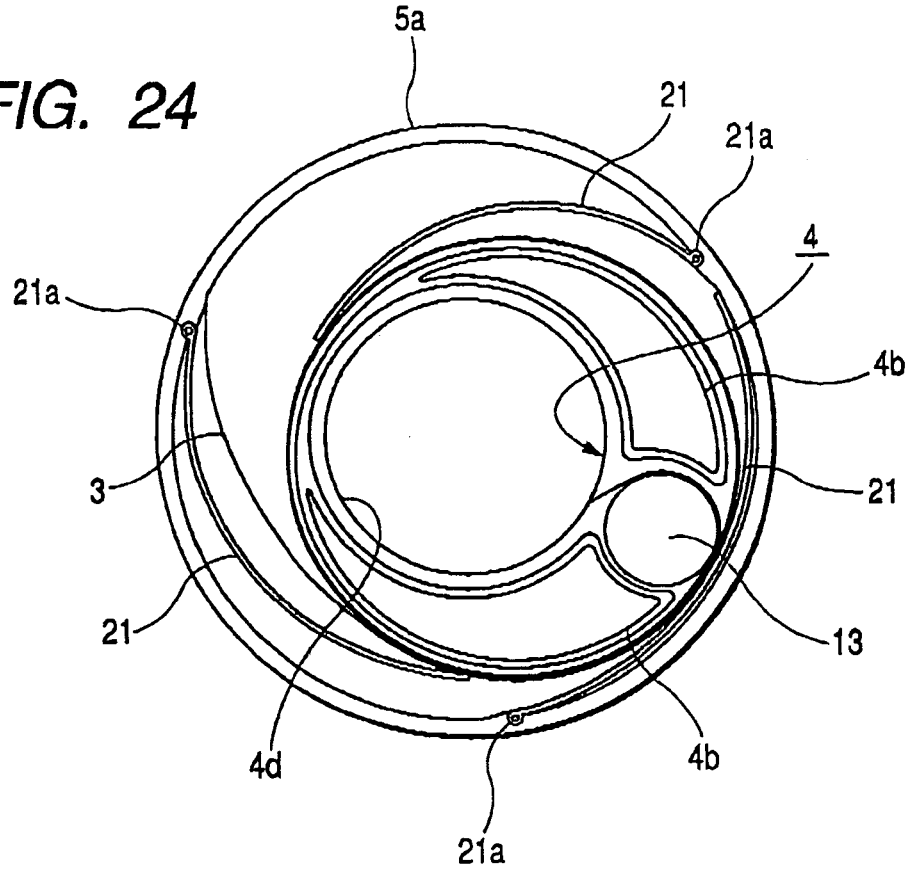
FIG. 24 is a plan view of the holder relating to the eleventh embodiment of the present invention.

Next, an eleventh embodiment according to a twelfth aspect of the present invention will be described with reference to FIG. 24. The difference of the eleventh embodiment from the first embodiment is that the stator comprises resilient restraining pieces on its outer tube. Therefore, the same members as those of the first embodiment are designated by the same referential numerals, and the description thereof will be omitted. FIG. 24 is a plan view illustrating the holder of the eleventh embodiment of the present invention.

By the outer tube 5*a* of the stator 1 (case 5) of FIG. 24 are supported three resilient restraining pieces 21 made of synthetic resin, and each resilient restraining piece 21 extends inward to the annular space 9 and is in contact with the flat cable 3 elastically. As shown in FIG. 24, on one end of these elastic restraining pieces 21 is formed a supporting element 21*a* having a hole, thus each resilient restraining piece 21 is supported by the outer tube 5*a* at 120-degree intervals. These resilient restraining pieces 21 curves at a similar rate to the inner surface of the outer tube 5*a*, and each resilient restraining piece 21 possesses the resilient force that exerts on the outer surface of the guiding wall 4*b*.

Next, the operation of the rotating connector of the above configuration will be described on the basis of FIG. 4. In addition, in FIG. 4, the stator 1 and the rotor 2 including the outer tube 5*a* or the inner tube 7*b* are omitted, and the resilient restraining piece 21 are also omitted for the simplification of the figure.

FIG. 4A illustrates the wound-tight state where most of the flat cable 3 is wound on the outer circumferential surface of the inner tube 7*b*. In this case, each resilient restraining piece 21, omitted in the figure, is in contact with the outer surface of the guiding wall 4*b* of the holder 4. If the rotor 2 is rotated counterclockwise (the direction of arrow A) in such a wound-tight state, the inverting section 3*a* of the flat cable 3 moves counterclockwise by rotating angle smaller than that of the rotor 2, and the roller 13 and the holder 4 follow the inverting section 3*a* to move counterclockwise, and, as shown in FIG. 4B, the flat cable 3 is unreeled twice as much as the rotating angle from the inner tube 7*b* to the inner surface of the outer tube 5*a*. If the rotor 2 is further rotated counterclockwise, as shown in FIG. 4C, the flat cable 3 unreeled to the outer tube 5*a* is wound on the outer surface of the guiding wall 4*b* of the holder 4, and, finally, most part of the flat cable 3 is wound on the outer surface of the guiding wall 4*b*, the wound-back state. In addition, each resilient restraining piece 21, omitted in the figure, elastically transforms in respond to the change of the flat cable 3 in the diametric direction with the fixed end as a supporting point, for example, in the middle of the wound-back operation shown in FIG. 4B, the elastic restraining piece is pushed to the inner surface of the outer tube 5*a* with the flat cable 3, and in the wound-back state shown in FIG. 4C, it is in contact with the outer surface of the flat cable 3 wound on the guiding wall 4*b*. In addition, contrary to the above, if the rotor is rotated clockwise (the direction of arrow B) in the wound-back state shown in FIG. 4C, the flat cable 3 is unreeled to the inner surface of the outer tube 5*a* from the guiding wall 4*b*, and, if the rotor 2 is further rotated clockwise, as shown in FIG. 4A, most of the flat cable 3 is wound on the outer circumferential surface of the inner tube 7*b*, the wound-tight state. Similarly, each resilient restraining piece 21, omitted in the figure, resiliently transforms in respond to the change of the flat cable 3 in the diametric direction with the fixed end as a supporting point.

As above, in the rotating connector relating to the present embodiment, a plurality of resilient restraining pieces extending inward to the annular space 9 are supported by the outer tube 5*a* of the stator 1, and the flat cable 3 is urged to the outer surface of the guiding wall 4*b* with the resilient force of the resilient restraining pieces 21, thus the flat cable 3 is restrained from moving in the annular space 9 in the middle of the wound-tight or back operation even when the vibration in the diametric direction of the annular space 9 is externally applied to the rotating connector. In addition, three resilient restraining pieces 21 are arranged along the circumferential direction of the outer tube 5*a* at 120-degree intervals, thus the flat cable 3 can be resiliently urged to the center of the annular space 9 in a balanced manner. In addition, the resilient restraining pieces 21 are formed curved at a similar rate to the inner surface of the outer tube 5*a*, and the hole of the supporting element 21*a* formed at one end of these resilient restraining pieces 21 are put into the supporting column formed on the outer tube 5*a*, and then the resilient restraining pieces 21 are supported by the outer tube 5*a* in a cantilevered crossbeam shape, thus the resiient restraining pieces 21 can be easily provided on the outer tube 5*a*.

In addition, in the above-mentioned embodiment, three resilient restraining pieces 21 supported by the outer tube 5*a* are described, however, it is needless to say that the number of the resilient restraining piece 21 is not limited thereto.

In addition, in the above-mentioned embodiment, the rotating connector using a single piece of flat cable is described, however, it is needless to say that the present invention may be applied to the double winding type rotating connector using two pieces of flat cables.

Figure 25:
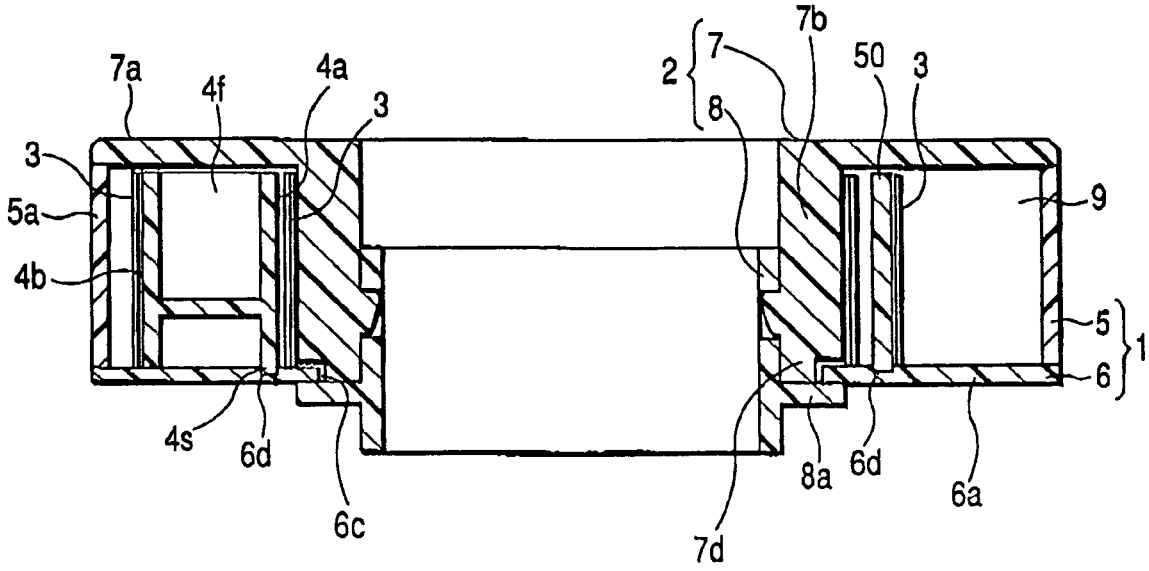
FIG. 25 is a cross sectional view of the rotating connector relating to the twelfth embodiment of the present invention.
Figure 26:
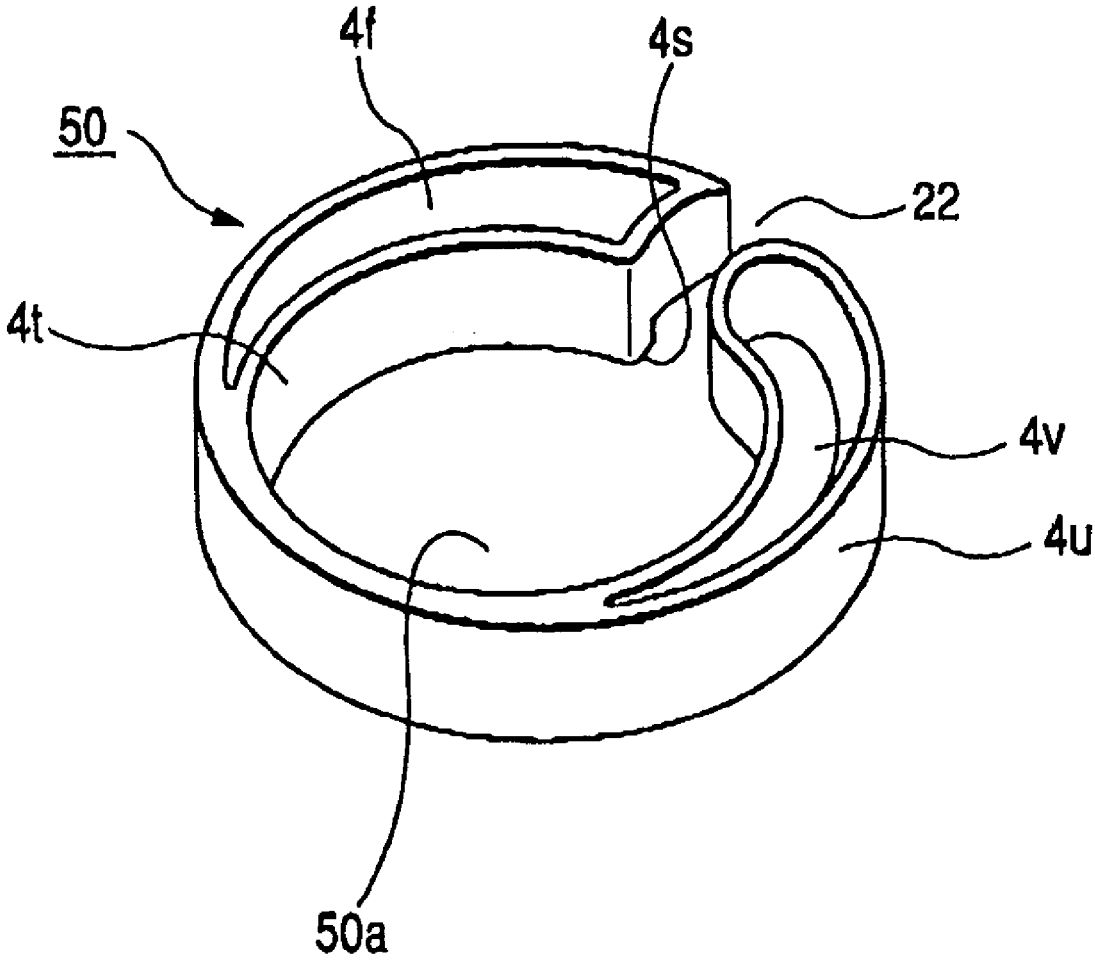
FIG. 26 is a perspective view of the guide portion of the present invention.
Figure 28:
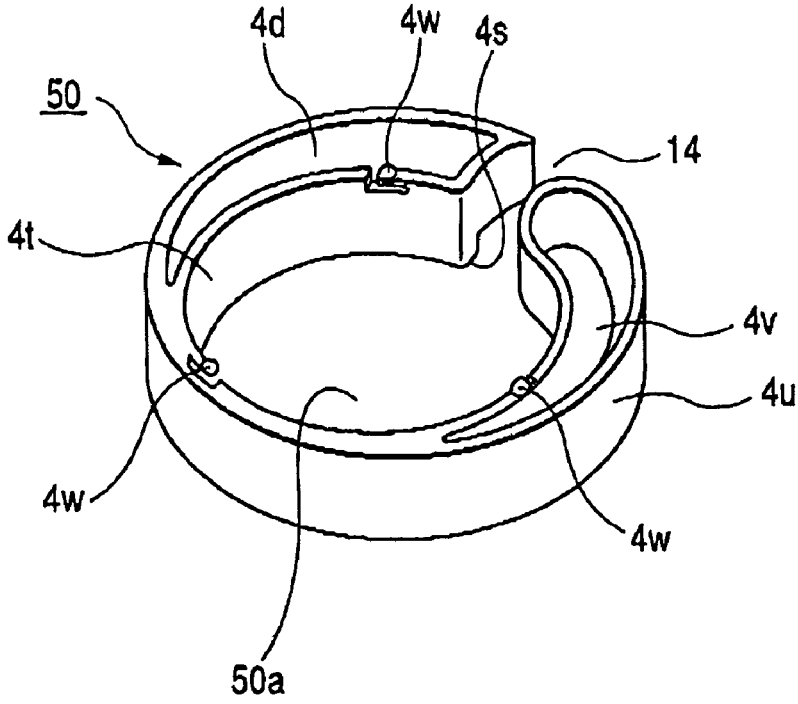
FIG. 28 is a perspective view illustrating the example of a transformed guide portion of the present invention.
Figure 29:
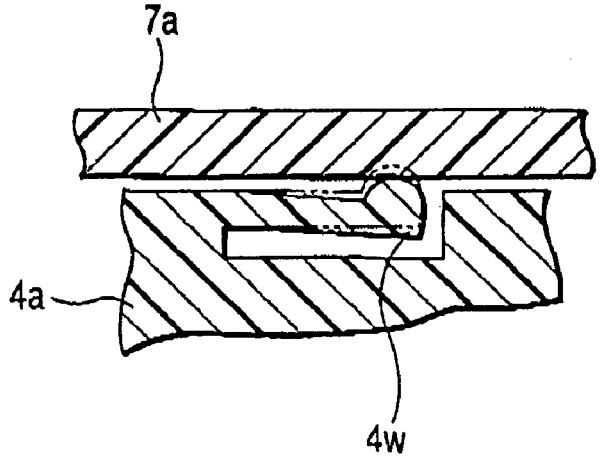
FIG. 29 is an explanatory view of the elastic tiny piece included in the guide portion of the present invention.

Next, a twelfth embodiment according to a thirteenth aspect of the present invention will be described with reference to FIGS. 25 to 29. The difference of the twelfth embodiment from the first embodiment is that a C-shaped guide portion is used instead of the holder, and guide grooves are provided on the lower plate. Therefore, the same members as those of the first embodiment are designated by the same referential numerals, and the description thereof will be omitted. FIG. 25 is a cross section view illustrating the rotating connector of the twelfth embodiment of the present invention, and FIG. 26 is a perspective view illustrating the guide portion of the present invention, and FIG. 27 is an explanatory view illustrating the operation of the rotating connector, and FIG. 28 is a perspective view illustrating the example of a transformed guide portion of the present invention, and FIG. 29 is an explanatory view of the elastic tiny piece included in the guide portion of the present invention.

A ring-shaped guide groove 6*d* is formed around the center hole 6*c* of the stator 1.

In addition, the synthetic resin guide portion 50 is C-shaped, and an annular penetrating hole 50*a* is formed in the center of the guide portion 50. This penetrating hole 50*a* is put into the outer surface of the inner tube 7*b*, and the guide portion 50 is loaded on the lower plate 6*a* of the cover 6 and can rotate in the annular space 9. An inner surface 4*t* of the guide portion 50 is concentric to the penetrating hole 50*a*, but an outer surface 4*u* of the guide portion 50 is substantially eccentric to the center of the penetrating hole 50*a*, and the inner surface 4*t* and the outer surface 4*u* are connected through the opening 14 in the location that have the maximum eccentric amount. In other words, the distance from the rotating axis of the rotor 2 to the outer surface 4*u* of the guide portion 50 becomes the maximum in the vicinity of the opening 14, and the above-mentioned reversing section 3*a* of the flat cable 3 is located in this opening 14 (see FIG. 27). In addition, a protrusion 4*s* is formed at the lower end of the inner surface 4*t* of the guide portion 50, and is rotatably inserted to the guide groove 6*d* formed on the lower plate 6*a* of the cover 6. In addition, concave cavities 4*v* are formed between the inner surface 4*t* and the outer surface 4*u* of the guide portion 50, and the weight of the guide portion 50 can be decreased due to these cavities 4*v*.

Next, the operation of the rotating connector of the above configuration will be described on the basis of FIG. 27. In addition, in FIG. 27, the stator 1 and the rotor 2 including the outer tube 5*a* or the inner tube 7*b* are omitted.

Figure 27A:
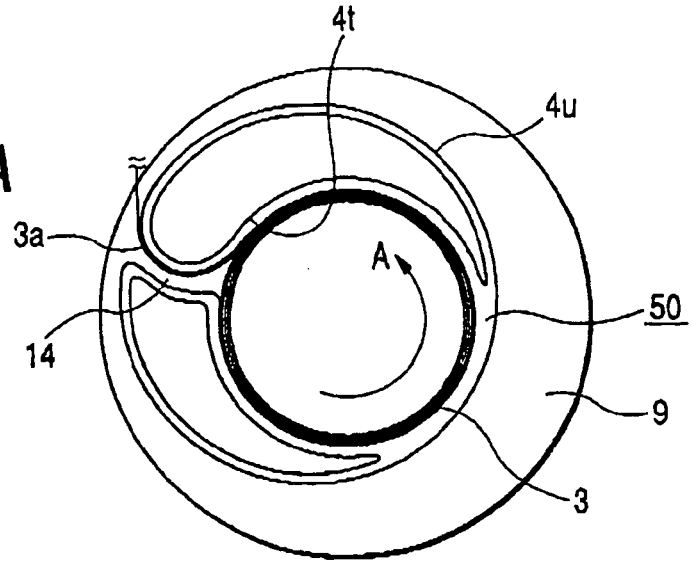
FIG. 27 is an explanatory view illustrating the operation of the rotating connector of the present invention.
Figure 27B:
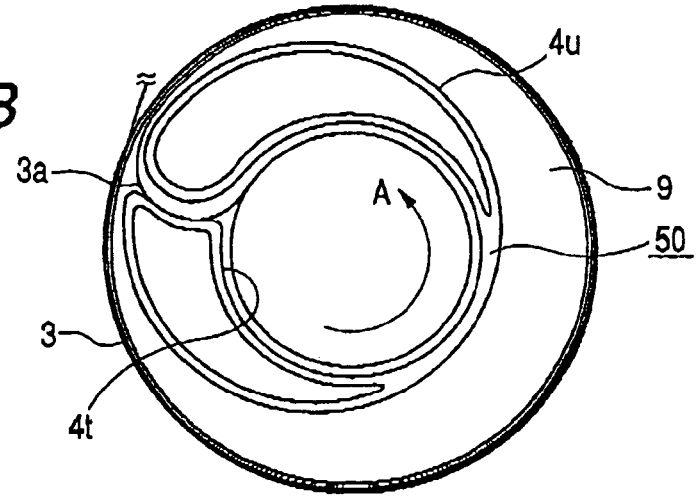
Figure 27C:
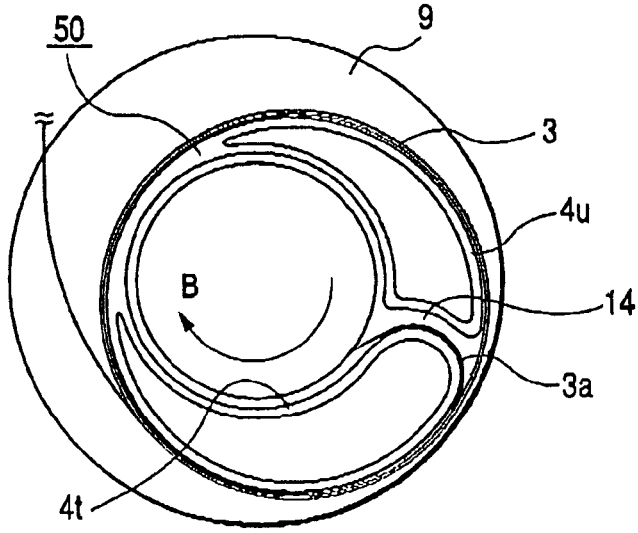

FIG. 27 illustrates the wound-tight state where most of the flat cable 3 is wound on the outer circumferential surface of the inner tube 7*b*. If the rotor 2 is rotated counterclockwise (the direction of arrow A) in such a wound-tight state, the reversing section 3*a* of the flat cable 3 moves counterclockwise by rotating angle smaller than that of the rotor 2, and the guide portion 50 follows the inverting section 3*a* to move counterclockwise, and, as shown in FIG. 27B, the flat cable 3 is unreeled twice as much as the rotating angle from the inner tube 7*b* to the inner surface of the outer tube 5*a* through the opening 14 of the guide portion 50. If the rotor 2 is further rotated counterclockwise, as shown in FIG. 270, the flat cable 3 unreeled to the outer tube 5*a* is wound on the outer surface 4*u* of the guide portion 50, and, finally, most part of the flat cable is wound on the outer surface 4*u* of the guide portion 50, the wound-back state. Contrary to the above, if the rotor is rotated clockwise (the direction of arrow B) in the wound-back state shown in FIG. 27C, the flat cable 3 is unreeled to the inner surface of the outer tube 5*a* from the outer surface 4*u* of the guide portion 50, and, if the rotor 2 is further rotated clockwise, as shown in FIG. 27A, most of the flat cable 3 is wound on the outer circumferential surface of the inner tube 7*b*, the wound-tight state.

As above, in the rotating connector relating to the present embodiment, in the middle of the transition between the wound-tight state shown in FIG. 27A and the wound-back state shown in FIG. 270, as shown in FIG. 27B, the flat cable 3 is once unreeled to the inner surface of the outer tube 5*a* located in the outside of the guide portion 50, but it is wound on the outer surface 41 of the guide portion 50 arranged in the annular space 9, and the circumferential length of the outer surface 4*u* of the guide portion 50 is much smaller than that of the inner surface of the outer tube 5*a*, thus the length of the required flat cable 3 can be decreased substantially. In addition, the guide portion 50 is C-shaped, and the outer surface 4*u* of the guide portion 50 is eccentric to the tube-shaped inner surface 4*t*, and the protrusion 4*s* protruded from the lower end of the inner surface 4*t* of this guide portion 50 is slidably engaged with a ring-shaped guide grooves 6*d* formed on the lower plate 6*a*, thus the guide portion 50 can have a smaller diameter to reduce its weight, and can rotate smoothly in the annular space 9. In addition, in the case of the present embodiment, the protrusions are formed continuously along the whole lower end of the inner surface 4*t* of the guide portion 50, however, a plurality of protrusions 4*s* may be sprinkled intermittently along the lower end of the inner surface 4*t*.

FIG. 28 is a perspective view illustrating the example of a transformed guide portion 50. A plurality of resilient tongues 4*w* are formed as one body in a cantilevered crossbeam shape on the upper end of the inner surface 4*t* of the guide portion 50 as a resilient urging element. At least three resilient tongues 4*w* are formed along the circumferential direction on the inner surface 4*t*, for example, at 120-degree intervals, and the front end (free end) of the resilient tongue 4*w* protrudes from the upper end of the inner surface 3*t* and has a hemispheric curved face. As shown in FIG. 29, the curved face of resilient tongue 4*w* is in contact with the lower face of the upper plate 7*a* of the upper rotor 7 elastically, thus the guide portion 50 is resiliently urged to the upper face of the lower plate a with the repulsive force of the resilient force of the resilient tongue 4*w*, and the protrusions 4*s* formed at the lower end of the inner surface 4*t* of the guide portion 50 are pushed and contacted with the bottom face of the guide groove 6*d*. Therefore the guide portion 50 is restrained from moving up and down in the annular space 9 with the resilient urging force of the resilient tongues 4*w* even when the vibration in the rotating axis direction of the rotor 2 is applied externally, and, finally, the collision of the upper end of the guide portion 50 with the lower face of the upper plate 7*a* can be prevented, and the occurrence of the noise due to the collision can be decreased.

EFFECT OF THE INVENTION

The rotating connector of the first aspect has the guide portion extending to surround the inner tube with the opening through which the intermediate reversing section of the flat cable is passed to be anchored on the holder that is rotatably arranged in the annular space defined between the inner tube of the rotor and the outer tube of the stator in a fashion that the distance from the rotating axis of the rotor to the outer surface of the guide portion becomes the maximum in the vicinity of the opening, thus the flat cable is wound back on the guide portion with a smaller diameter than that of the outer tube, and thus the length of the required flat cable can be decreased as much.

Further, the rotating connector of the second aspect has the guiding wall extending to surround the inner tube with the opening through which the intermediate reversing section of the flat cable is passed to be anchored on the holder that is rotatably arranged in the annular space defined between the inner tube of the rotor and the outer tube of the stator in a fashion that the distance from the rotating axis of the rotor to the outer surface of the guiding wall becomes the maximum in the vicinity of the opening, thus the flat cable is wound back on the guiding wall with a smaller diameter than that of the outer tube, and thus the length of the required flat cable can be decreased as much.

Further, the rotating connector of the third aspect has the guiding wall extending to surround the inner tube with the opening through which the intermediate reversing section of the flat cable is passed to be anchored on the holder that is rotatably arranged in the annular space defined between the inner tube of the rotor and the outer tube of the stator in a fashion that the distance from the rotating axis of the rotor to the outer surface of the guiding wall becomes the maximum in the vicinity of the opening, thus the flat cable is wound back on the guiding wall with a smaller diameter than that of the outer tube, and thus the length of the required flat cable can be decreased as much. In addition, the convexities and the concavities reducing the contact area with the flat cable are formed on the outer surface of the guiding wall, thus the flat cable can be unreeled smoothly with no adherence to the outer surface of the guiding wall in the wound-tight operation, and the rotor or the holder can rotate smoothly.

Further, the rotating connector of the fourth aspect has the guiding wall extending to surround the inner tube with the opening through which the intermediate reversing section of the flat cable is passed to be anchored on the holder that is rotatably arranged in the annular space between the inner tube of the rotor and the outer tube of the stator in a fashion that the distance from the rotating axis of the rotor to the outer surface of the guiding wall becomes the maximum in the vicinity of the opening, thus the flat cable is wound back on the guiding wall with a smaller diameter than that of the outer tube, and thus the length of the required flat cable can be shortened substantially as much. In addition, the concave wall and the convex wall facing to each other are formed as one body in the guiding wall having the inner surface and the eccentric outer surface through the opening, the flat cable can be wound tight or back smoothly by this guiding wall, thus the reduction of the cost can be attained from the simplification of the configuration of the holder.

Further, the rotating connector of the fifth aspect has the guiding wall extending to surround the inner tube with the opening through which the intermediate reversing section of the flat cable is passed to be anchored on the holder that is rotatably arranged in the annular space between the inner tube of the rotor and the outer tube of the stator in a fashion that the distance from the rotating axis of the rotor to the outer surface of the guiding wall becomes the maximum in the vicinity of the opening, thus the flat cable is wound back on the guiding wall with a smaller diameter than that of the outer tube, and thus the length of the required flat cable can be shortened substantially as much. In addition, the flat cable is guided by the inner wall portion, the coupling wall portion and the outer wall portion provided on the holder, thus the reduction in the weight and the cost of the holder can be attained, and the holder can be rotated smoothly.

Further, the rotating connector of the sixth aspect has the guiding wall extending to surround the inner tube with the opening through which the intermediate reversing section of the flat cable is passed to be anchored on the holder that is rotatably arranged in the annular space between the inner tube of the rotor and the outer tube of the stator in a fashion that the distance from the rotating axis of the rotor to the outer surface of the guiding wall becomes the maximum in the vicinity of the opening, thus the flat cable is wound back on the guiding wall with a smaller diameter than that of the outer tube, and thus the length of the required flat cable can be shortened substantially as much. In addition, the flat cable is guided by a plurality of columns provided in the non-circular area of the holder, thus the reduction in the weight and the cost of the holder can be attained, and the rotor can be rotated smoothly.

Further, the rotating connector of the seventh aspect has a plurality of hollow tube-shaped walls sprinkled in the circumferential direction to surround the inner tube provided on the synthetic resin holder that is rotatably arranged in the annular space between the inner tube of the rotor and the outer tube of the stator, and an imaginary inner circumferential surface joining the inner side of these hollow tube-shaped walls is set almost concentric to the inner tube, and an imaginary outer circumferential surface joining the outer side of these hollow tube-shaped walls is made eccentric to the center of the inner tube, and the opening through which the intermediate inverting section of the flat cable is passed is provided in the location where the imaginary outer circumferential surface becomes the maximum, thus the flat cable is wound back on the imaginary outer circumferential surface of the hollow tube-shaped walls having smaller diameters than that of the outer tube of the stator, and thus the length of the required flat cable can be decreased substantially. In addition, each hollow tube-shaped wall guiding the flat cable is shaped a hollow tube-shaped element that contains no synthetic resin in it, thus the reduction in the weight and the cost of the holder can be attained, and the rotor can be rotated smoothly.

Further, the rotating connector of the eighth aspect has the annular flat plate having an outer diameter almost the same as the inner diameter of the outer tube on the holder that is rotatably arranged in the annular space between the inner tube of the rotor and the outer tube of the stator, and the guiding wall having the outer surface eccentric to the inner surface extending in a concentric circle shape to the inner tube is provided on this annular flat plate, and the opening through which the intermediate inverting section of the flat cable is passed is provided at the location where the diameter of the guiding wall becomes the maximum, thus the flat cable is wound back on the outer surface of the guiding walls having smaller diameters than that of the outer tube of the stator, and thus the length of the required flat cable can be decreased substantially as much. In addition, the synthetic resin-removed parts in which synthetic resin is removed are formed on at least one of the annular flat plate of the holder and the guiding wall, thus the reduction in the weight and the cost of the holder can be attained, and the rotor can be rotated smoothly.

Further, the rotating connector of the ninth aspect defines the annular space between the inner tube and the upper plate of the rotor; and the outer tube and the lower plate of the stator, and has the annular flat plate having the outer diameter almost the same as the inner diameter of the outer tube in the synthetic resin holder that is rotatably arranged in this annular space; a guiding wall having the outer surface eccentric to the inner surface extending in a concentric circle shape to the inner tube on this annular flat plate; and the opening through which the intermediate inverting section of the flat cable is passed provided in the location where the diameter of this guiding wall becomes the maximum, thus the flat cable is wound back on the outer surface of the guiding wall having a smaller diameter than that of the outer tube of the stator, and the length of the required flat cable can be decreased substantially. In addition, the first resilient urging element urging the guiding wall to the upper plate of the rotor is provided on at least one of the lower plate of the stator and the annular flat plate of the holder, thus the holder is restrained from moving up and down in the annular space even when the vibration in the rotating axis direction of the rotor is applied externally, and thus the noise due to the collision of the holder with the upper plate or the lower plate can be decreased.

Further, the rotating connector of the tenth aspect defines the annular space between the inner tube and the upper plate of the rotor; and the outer tube and the lower plate of the stator, and has the guiding wall through which the intermediate reversing section of the flat cable is passed provided in the annular flat plate of the holder that is rotatably arranged in this annular space; the inner surface of this guiding wall having the concentric circle shape to the penetrating hole drilled in the center of the annular flat plate; and the guiding wall formed in a fashion that the distance from the rotating axis of the rotor to the outer surface of the guiding wall becomes the maximum in the vicinity of the opening, thus the flat cable is wound back on the outer surface of the guiding wall having a smaller diameter than that of the outer tube, and thus the length of the required flat cable can be decreased substantially. In addition, the small-diameter part coupled through the inner tube and the stepped-part is formed in the rotor, and the penetrating hole of the holder is put into this small-diameter part, and the circumferential edge of the penetrating hole is pushed to the stepped-part by the second resilient urging element, thus the holder is restrained from moving up and down in the annular space even when the vibration in the rotating axis direction of the rotor is applied externally, and thus the noise due to the collision of the holder with the upper plate or the lower plate can be decreased.

Further, the rotating connector of the eleventh aspect defines the annular space between the inner tube and the upper plate of the rotor; and the outer tube and the lower plate of the stator, and has the annular flat plate facing the lower plate on the holder that is rotatably arranged in this annular space; the guiding wall having the outer surface eccentric to the inner surface extending in a concentric circle shape to the inner tube on this annular flat plate; and the opening through which the intermediate reversing section of the flat cable is passed provided in the location where the diameter of this guiding wall becomes the maximum, thus the flat cable is wound back on the outer surface of the guiding wall having a smaller diameter than that of the outer tube of the stator, and the length of the required flat cable can be decreased substantially. In addition, the lubricative sheet is adhered on the upper face of the lower plate defining the lower part of the annular space, thus the annular flat plate of the holder slides on the lubricative sheet and rotates in the annular space, and thus the noise occurred from the contact area between the holder and the lower plate can be decreased.

Further, the rotating connector of the twelfth aspect defines the annular space between the inner tube of the rotor and the outer tube of the stator, and has the annular flat plate on the holder that is rotatably arranged in this annular space; the guiding wall having the outer surface eccentric to the inner surface extending in a concentric circle shape to the inner tube on this annular flat plate; and the opening through which the intermediate reversing section of the flat cable is passed provided in the location where the diameter of this guiding wall becomes the maximum, thus the flat cable is wound back on the outer surface of the guiding wall having a smaller diameter than that of the outer tube of the stator, and the length of the required flat cable can be decreased substantially. In addition, the resilient restraining elements extending into the annular space are provided in the outer tube, and urge the flat cable to the center of the annular space, thus the vibration of the flat cable in the diametric direction is restrained even when the vibration in the diametric direction of the annular space is applied externally, and the occurrence of noise can be decreased.

Further, in the rotating connector of the thirteenth aspect, the annular space is defined between the lower plate and the outer tube of the stator; and the upper plate and the inner tube of the rotor, and the guide portion that is rotatably provided in this annular space is a C-shaped element that has the outer surface eccentric to the inner surface extending in a concentric circle shape to the inner tube, and the opening through which the intermediate reversing section of the flat cable is passed is provided in the location where the diameter of the guide portion becomes the maximum, and also the protrusions protruding from the lower end of the inner surface of the guide portion are slidably engaged with ring-shaped guide grooves formed on the lower plate, thus the flat cable is wound back on the outer surface of the guide portion having a smaller diameter than that of the outer tube of the stator, and the length of the required flat cable can be decreased substantially. In addition, the guide portion is a C-shaped element having the outer wall eccentric to the cylinder-shaped inner wall, and the protrusions protruding from the lower end of this guide portion are slidably engaged with the ring-shaped guide ditches formed on the lower plate of the stator, thus the guide portion can rotate smoothly while the reduction in the weight of the guide portion is sought.

What is claimed is:

1. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein a guide portion surrounding the inner tube is provided on the holder, and a distance from the rotating axis of the rotor to the outer surface of the guide portion becomes the maximum in the vicinity of the opening.

2. A rotating connector comprising;

a stator having an outer tube;

a rotor that is rotatably coupled to the stator and has an inner tube that defines an annular space between the rotor and the outer tube;

a flat cable that is contained in the annular space, the winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein a guiding wall extending so as to surround the inner tube is provided on the holder, and the distance from the rotating axis of the rotor to the outer surface of the guiding wall becomes the maximum in the vicinity of the opening.

3. The rotating connector according to claim 2, wherein the guiding wall has a tube-shaped outer surface, and has such a configuration that the flat cable sliding to the outer tube through the opening is circularly wound on the guiding wall that is eccentric to the rotating axis of the rotor.

4. The rotating connector according to claim 2, wherein the guiding wall comprises a regulating element located in the vicinity of the opening and an annular element surrounding most of the inner tube, and has a configuration such that the flat cable sliding to the outer tube through the opening is non-circularly wound on the guiding wall.

5. The rotating connector according to claim 3, wherein a roller is supported in the vicinity of the opening of the holder, and the flat cable sliding to the outer tube through the opening in contact with the roller and the guiding wall.

6. The rotating connector according to claim 5, wherein the holder comprises an annular flat plate having an outer diameter almost the same as the inner diameter of the outer tube, the roller being journalled, and the guiding wall being disposed thereon.

7. A rotating connector comprising;

a stator having an outer tube;

a rotor that is rotatably coupled to the stator and has an inner tube that defines an annular space between the rotor and the outer tube;

a flat cable that is contained in the annular space, the winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein a guiding wall extending so as to surround the inner tube is provided on the holder, and the distance from the rotating axis of the rotor to an outer surface of the guiding wall is set to be the maximum in the vicinity of the opening, and on the outer surface of the guiding wall are formed concavities and convexities that reduce the contact area with the flat cable.

8. The rotating connector according to claim 7, wherein the concavities and convexities are formed by alternating concavity parts and convexity parts along a circumferential direction on the outer surface of the guiding wall.

9. The rotating connector according to claim 7, wherein the guiding wall has the outer surface eccentric to an inner surface extending in a concentric circle shape to the inner surface, and cavities are formed between the inner tube and the outer tube of the guiding wall.

10. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein a guiding wall having an outer surface eccentric to an inner surface extending in a concentric circle shape to the inner tube is provided on the holder, and the opening through which the intermediate reversing section of the flat cable is passed is provided in a location where a diameter of the guiding wall becomes a maximum, and a concave wall and a convex wall facing each other with the opening between them are formed as one body in the guiding wall.

11. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the holder is provided with inner wall portion extending in a circumferential direction so as to surround most of the inner tube, a coupling wall extending outward along the opening from the inner wall and an outer wall portion extending to the inner wall from an outer end of the coupling wall, and the flat cable is non-circularly wound on the inner wall portion and the outer wall portion of the holder from the inner tube through the opening.

12. The rotating connector according to claim 11, wherein the holder has an annular flat plate having an outer diameter almost the same as the inner diameter of the outer tube, the inner wall portion, the coupling wall and the outer wall portion are provided on the annular flat plate.

13. The rotating connector according to claim 11, wherein a roller is rotatably journaled on the holder, and faces the coupling wall with the opening between them.

14. The rotating connector according to claim 13, wherein an opposing wall facing the coupling wall with the opening and the roller between them is provided on the holder, and an inner end of the opposing wall is connected with the inner wall portion, and at an outer end of the opposing wall another outer wall portion extending to the inner wall portion is provided.

15. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the holder is provided with an annular flat plate having a center hole put into the inner tube, and a plurality of columns are provided on the annular flat plate to surround the center hole, the columns being sprinkled in a non-circular area such that a distance from a rotating axis of the rotor becomes a maximum in the vicinity of the opening, and the flat cable is non-circularly wound on the columns located in an outer edge of the non-circular area from the inner tube through the opening.

16. The rotating connector according to claim 15, wherein some of the columns have a wedge shape continuing from the opening along the outer edge of the non-circular area, and the remainder of the columns have a cylinder shape.

17. The rotating connector according to claim 15, wherein rollers are rotatably journaled on some or all of the columns.

18. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate inverting section of the flat cable is passed;

wherein a plurality of hollow tube-shaped walls are sprinkled in the circumferential direction on the holder to surround the inner tube, and an imaginary inner circumferential surface joining the inner surface of the hollow tube-shaped walls is set almost concentric to the inner tube, and an imaginary outer circumferential surface joining the outer surface of the hollow tube-shaped walls is set eccentric to the center of the inner tube, and the opening through which the intermediate reversing section of the flat cable is passed is provided in a location where the diameter of the imaginary outer circumferential surface becomes a maximum.

19. The rotating connector according to claim 18, wherein the holder has an annular flat plate having an outer diameter almost the same as an inner diameter of the outer tube, and the hollow tube-shaped walls are provided on an annular flat plate.

20. The rotating connector according to claim 18, wherein complementary walls are provided between the hollow tube-shape walls on the holder, and are arranged on the imaginary inner circumferential surface.

21. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the holder is provided an annular flat plate having an outer diameter almost the same as the inner diameter of the outer tube, and the annular flat plate is provided a guiding wall having an outer surface eccentric to an inner surface extending in a concentric circle shape to the inner tube, and the opening through which the intermediate reversing section of the flat cable is passed is provided in the location where a diameter of the guiding wall becomes a maximum, and synthetic resin-removed parts are formed in at least one of the annular flat plate and the guiding wall.

22. The rotating connector according to claim 21, wherein the synthetic resin-removed parts are concave cavities formed between the inner surface and the outer surface of the guiding wall.

23. The rotating connector according to claim 21, wherein the synthetic resin-removed parts are a plurality of penetrating holes that penetrate the inner surface and the outer surface of the guiding wall.

24. The rotating connector according to claim 21, wherein the synthetic resin-removed parts are a plurality of holes that penetrate the plate of the annular flat plate.

25. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein in the holder is provided with an annular flat plate having an outer diameter almost the same as an inner diameter of the outer tube and facing a lower plate, and on the annular flat plate is provided a guiding wall having an outer surface eccentric to the inner surface extending in a concentric circle shape to the inner tube, and the opening through which the intermediate reversing section of the flat cable is passed is provided in the location where the diameter of the guiding wall becomes a maximum, and on at least one of the lower plate and the annular flat plate are provided first resilient urging elements urging the lower plate and the annular flat plate in the direction that they separate from each other.

26. The rotating connector according to claim 25, wherein the first resilient urging elements are composed of resilient tongues shaped as a cantilevered crossbeam on the annular flat plate, and the free ends of the resilient tongues are in contact with the lower plate elastically.

27. The rotating connector according to claim 26, wherein at least three resilient tiny pieces are formed along a circumferential direction of the annular flat plate.

28. The rotating connector according to claim 26, wherein the resilient tongues have a curved face at their free end.

29. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the inner surface of the guiding wall is shaped like a concentric circle to a circular penetrating hole formed in the center of the annular flat plate, and the guiding wall has a shape such that a distance from a rotating axis of the rotor to the outer surface becomes a maximum in the vicinity of the opening, and the rotor is formed a small-diameter part connected with the inner tube through a stepped part, and on at least one of the annular flat plate and a lower plate are provided second resilient urging elements pushing and contacting the circumferential edge of a penetrating hole put into the small-diameter part to the stepped part.

30. The rotating connector according to claim 29, wherein the annular flat plate has an outer diameter almost the same as an inner diameter of the outer tube, and the second resilient urging elements are composed of a plurality of resilient tongues formed in a cantilevered cross beam shape on the annular flat plate.

31. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate inverting section of the flat cable is passed;

wherein the holder is provided an annular flat plate facing a lower plate, and the annular flat plate is provided a guiding wall having an outer surface eccentric to an inner surface extending in a concentric circle shape to the inner tube, and the opening through which the intermediate reversing section of the flat cable is passed is provided in a location where the diameter of the guiding wall becomes a maximum, and a lubricative sheet is adhered on an upper face of the lower plate.

32. The rotating connector according to claim 31, wherein curved face-shaped protrusions are formed on a lower face of the annular flat plate, and these protrusions slide on the lubricative sheet.

33. The rotating connector according to claim 31, wherein a further lubricative sheet is adhered on a lower face of an upper plate.

34. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the holder is provided an annular flat plate facing a lower plate, and the annular flat plate is provided a guiding surface having an outer surface eccentric to an inner wall extending in a concentric circle shape to the inner tube, and the opening through which the intermediate inverting section of the flat cable is passed is provided in a location where a diameter of the guiding wall becomes a maximum, and resilient restraining elements extending inward to the annular space are provided on the outer tube.

35. The rotating connector according to claim 34, wherein a plurality of resilient restraining pieces are provided along a circumferential direction of the outer tube at regular intervals.

36. The rotating connector according to claim 34, wherein the resilient restraining pieces are shaped to be curved, and one end of each resilient restraining piece is supported by the outer tube in a cantilevered crossbeam shape.

37. A rotating connector comprising;

a stator having an outer tube;

a rotor that is rotatably coupled to the stator and has an inner tube that defines an annular space between the rotor and the outer tube;

a flat cable that is contained in the annular space, a winding direction of which is reversed at an intermediate section thereof, both ends thereof extending outward through the inner tube and the outer tube; and a holder that is rotatably arranged in the annular space and has an opening through which the intermediate reversing section of the flat cable is passed;

wherein the holder has a guide portion shaped like the shape of the letter C having an outer surface eccentric to an inner surface extending in a concentric circle shape to the inner tube, and the opening through which the intermediate reversing section of the flat cable is passed is provided in a location where a diameter of the guide portion becomes a maximum, and protrusions protruded from the lower end of an inner surface of the guide portion are slidably engaged with a ring-shaped guide groove formed on a lower plate.

38. The rotating connector according to claim 37, wherein the protrusions are formed along the inner surface of the guide portion continually or intermittently.

39. The rotating connector according to claim 37 wherein concave cavities are formed between the inner surface and the outer surface of the guide portion.

40. The rotating connector according to claim 37, wherein on at least one of an upper end of the guide portion and an upper plate are provided third resilient urging elements urging both in the direction that they separate from each other.

41. The rotating connector according to claim 40, wherein the third resilient urging elements are composed of a plurality of resilient tongues formed as the upper end of the inner surface of the guide portion, and free ends of the resilient tongues are in resilient contact with a lower face of the upper plate.

* * * * *